United States Patent [19]

Tam et al.

[11] Patent Number: 4,853,307

[45] Date of Patent: Aug. 1, 1989

[54] IMAGING MEMBER CONTAINING A COPOLYMER OF STYRENE AND ETHYL ACRYLATE

[75] Inventors: Man C. Tam; Steven Bloembergen; Gregory J. Kovacs; Carol A. Jennings; Rafik O. Loutfy; Sandra J. Gardner; Michael G. Taylor, all of Ontario, Canada

[73] Assignee: Xerox Corporation, Stamford, Conn.

[21] Appl. No.: 140,441

[22] Filed: Jan. 4, 1988

[51] Int. Cl.[4] ..... G03G 5/05; G03G 13/22

[52] U.S. Cl. ..... 430/41; 430/96

[58] Field of Search ..... 430/41, 96

[56] References Cited

U.S. PATENT DOCUMENTS

| | | | |
|---|---|---|---|
| 3,672,889 | 6/1972 | Baltazzi et al. | 430/96 X |
| 3,799,911 | 3/1974 | Dissen et al. | 430/96 X |
| 3,975,739 | 8/1976 | Goffe | 430/41 X |
| 4,081,273 | 3/1978 | Goffe | 430/41 |
| 4,482,622 | 11/1984 | Soden et al. | 430/128 X |
| 4,492,747 | 1/1985 | Brechlin | 430/96 |
| 4,640,879 | 2/1987 | Simmons et al. | 430/96 |

FOREIGN PATENT DOCUMENTS

| | | | |
|---|---|---|---|
| 715497 | 8/1965 | Canada | 430/96 |

*Primary Examiner*—Paul R. Michl
*Assistant Examiner*—Jeffery A. Linoeman
*Attorney, Agent, or Firm*—Peter H. Kondo; Judith L. Byorick

[57] ABSTRACT

An imaging system including a migration imaging member comprising a substrate and an electrically insulating softening layer adjacent the substrate, the softenable layer comprising a fracturable layer of electrically photosensitive migration marking material located substantially at or near the surface of the softenable layer spaced from the substrate, and a copolymer of styrene and ethyl acrylate in at least one layer adjacent the substrate, the copolymer comprising between about 40 and about 80 mole percent styrene, between about 20 and about 60 mole percent ethyl acrylate, the copolymer having a $M_n$ between about 4,000 and about 35,000, a $M_w$ between about 10,000 and about 80,000, a $T_g$ between about 30° C. and about 75° C., and a melt viscosity between about $1\times10^2$ poise and about $1\times10^6$ poise at 115° C.

The migration imaging member may be imaged by charging, imagewise exposing to activating radiation and developing with heat, solvent vapor, or solvent vapor pretreatment followed by heat. Some embodiments of the imaged member, wherein the softenable layer contains a charge transport material, may be utilized as a master in a zeroprinting process. The copolymer of styrene and ethyl acrylate may be in an adhesive layer of charge transport spacing layer between the substrate and the sofenable layer, or in the softenable layer itself. If desired, the copolymer in any of the aforesaid layers may be a terpolymer of styrene, ethyl acrylate and a copolymerizable organic acid having carbon-to-carbon unsaturation or a copolymerizable derivative of the organic acid.

22 Claims, No Drawings

IMAGING MEMBER CONTAINING A COPOLYMER OF STYRENE AND ETHYL ACRYLATE

BACKGROUND OF THE INVENTION

This invention relates generally to migration imaging, and more specifically to an improved migration imaging member and a process for using the improved migration imaging member.

Dry migration imaging members have been extensively described in the patent literature, for example, in U.S. Pat. No. 3,909,262 and U.S. Pat. No. 3,975,195, the disclosures of both being incorporated herein in their entirety. In a typical embodiment of a migration imaging system, a migration imaging member comprising a substrate, a layer of softenable material, and photosensitive marking material is imaged by first forming a latent image by electrically charging the member and exposing the charged member to a pattern of activating electromagnetic radiation such as light. Where the photosensitive marking material was originally in the form of a fracturable layer contiguous the upper surface of the softenable layer, the marking particles in the exposed area of the member migrate in depth toward the substrate when the member is developed by softening the softenable layer.

The expression "softenablen" as used herein is intended to mean any material which can be rendered more permeable thereby enabling particles to migrate through its bulk. Conventionally, changing the permeability of such material or reducing its resistance to migration of the migration marking material is accomplished by dissolving, swelling, melting or softening, by techniques, for example, such as contacting with heat, vapors, partial solvents, solvent vapors, solvents and combinations thereof, or by otherwise reducing the viscosity of the softenable material by any suitable means.

The expression "fracturable" layer or material as used herein, means any layer or material which is capable of breaking up during development, thereby permitting portions of said layer to migrate toward the substrate or to be otherwise removed. The fracturable layer may be particulate, semi-continuous, or microscopically discontinuous in various embodiments of the migration imaging members of the present invention. Such fracturable layers of marking material are typically contiguous to the surface of the softenable layer spaced apart from the substrate, and such fracturable layers may be substantially or wholly embedded in the softenable layer in various embodiments of the imaging members of the inventive system.

The expression "contiguous" as used herein is intended to mean in actual contact; touching; also, near, though not in contact; and adjoining, and is intended to generically describe the relationship of the fracturable layer of marking material in the softenable layer, vis-a-vis, the surface of the softenable layer spaced apart from the substrate.

The expression "adjacent" as used herein is intended to mean in actual contact; touching; also, near, though not in contact; and adjoining, and is intended to generically describe the relationship of one or more layers overlying the surface of the substrate.

The expression "optically sign-retained" as used herein is intended to mean that the dark (higher optical density) and light (lower optical density) areas of the visible image formed on the migration imaging member correspond to the dark and light areas of the image on any original that was employed.

The expression "optically sign-reversed" as used herein is intended to mean that the dark areas of the image formed on the migration imaging member correspond to the light areas of the image on the original and the light areas of the image formed on the migration imaging member correspond to the dark areas of the image on any original that was employed.

The expression "optical contrast density" as used herein is intended to mean the difference between maximum optical density ($D_{max}$) and minimum optical density ($D_{min}$) of an image. Optical density is measured for the purpose of this application by diffuse densitometers with a blue Wratten No. 94 filter. The expression "optical density" as used herein is intended to mean "transmission optical density" and is represented by the formula:

$$D=\log_{10}[lo/l]$$

where l is the transmitted light intensity and lo is the incident light intensity. For the purpose of this invention, the value of transmission optical density includes the substrate density of about 0.2 which is the typical density of a metallized polyester substrate. While contrast density is measured by diffuse densitometers in this application, it should be noted that measurement by specular densitometers gives substantially similar results.

There are various other systems for forming such images, where non-photosensitive or inert marking materials are arranged in the aforementioned fracturable layers, or dispersed throughout the softenable layer, as described in the aforementioned patents, which also discloses a variety of methods which may be used to form latent images upon migration imaging members.

Various means for developing the latent images may be used for migration imaging systems. These development methods include solvent wash-away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash-away or meniscus development method, the migration marking material in the light-struck region migrates toward the substrate through the softenable layer, which is softened and dissolved, and repacks into a more or less monolayer configuration. In migration imaging films supported by transparent substrates, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore the image-sense of the developed image is optically sign-reversed, i.e. positive to negative or vice versa. Various methods and materials and combinations thereof have previously been used to fix such unfixed migration images. In the other previously described heat or vapor development techniques, the softenable layer remains substantially intact after development, with the image being selffixed because the marking material particles are trapped within the softenable layer. In the heat, or vapor softening developing modes, the migration marking material in the light-struck region disperses in the depth of the softenable layer after development and this region exhibits $D_{min}$ which is typically in the range of 0.6–0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. This region thus exhibits maximum optical density ($D_{max}$). Therefore, the image sense of the heat or vapor developed images is optically signretaining, i.e. positive-to-positive or negative-to-negative.

Techniques have been devised to permit optically sign-reversed imaging with vapor development, but these techniques are generally complex and require critically controlled processing conditions. Such a technique is described, for example, in U.S. Pat. No. 3,795,512.

One common migration imaging member comprises a metalized plastic substrate bearing a softenable layer. For some demanding commercial applications, it is essential that the structural integrity and imaging properties of migration imaging members must be ensured under all practical usage conditions. Many prior art migration imaging members fail to meet these requirements because of poor mechanical properties of the softenable materials. For example, many migration imaging members, such as those containing a 80:20 mole ratio styrene-hexylmethacrylate copolymer in the softenable layer exhibit poor adhesive properties such that the softenable layer delaminates from the substrate when the members are rigorously handled during use. Additionally they provide insufficient blocking resistance in that blocking occurs under conditions of elevated temperatures and pressure, e.g. when the members are tightly wound in a roll during manufacture, storage or use. Furthermore some prior art softenable materials provide only inferior imaging characteristics because of improper viscoelastic properties, especially when heat only is used to develop the migration imaging member.

A xeroprinting master plate may be prepared from migration imaging members by uniform negative corona charging of the migration imaging members, imagewise exposure, followed by heating. The resulting imaged migration imaging member may then be used as a xeroprinting master. Xeroprinting is performed by uniform corona charging and uniform exposing the xeroprinting master to activating electromagnetic radiation; this yields an electrostatic latent image on the master; the electrostatic image is toned and the toner image is transferred and fused to paper to produce a print. The uniform charging, uniform exposure, toning, transfer and fusing steps may be repeated to produce multiple prints. To be useful as a xeroprinting master, it is necessary that the softenable layer of migration imaging members retain charge transport materials, such as the charge transport materials disclosed in U.S. Pat. No. 4,536,458 issued to Dominic S. Ng and U.S. Pat. No. 4,536,457 issued to Man C. Tam, in the softenable layer over many imaging cycles in order to provide imagewise photodischarge and charge transport capabilities to the xeroprinting master. For some commercial printing applications demanding high quality and resolution such as in color proofing and printing, xerographic liquid toner is generally the preferred developer material because of the smaller toner particle size which produces superior resolution prints compared with the relatively largersized dry toners. Conventional xerographic liquid developers typically comprise a liquid carrier having marking particles dispersed therein. However xeroprinting masters prepared from prior art migration imaging members, for example, those containing a 80:20 mole ratio styrenehexylmethacrylate copolymer and N,N'-diphenyl-N,N'-bis(3''-methylphenyl)-(1,1'-biphenyl)-4,4'-diamine charge transport molecules in the softenable layer, suffer a severe loss of their charge transport properties when contacted with such liquid developers. This is because the charge transport molecules leach out of the softenable layer during contact with the liquid carrier component of liquid developers. This results not only in contamination of the liquid developers but also in rapid degradation of the charge transporting properties, and eventually the xeroprinting capability of the xeroprinting master during cycling. Additionally, in order to produce high quality prints of adequate optical density, the electrostatic contrast potential must be sufficiently high to provide a developable electrostatic latent image. The requirement of high electrostatic contrast potential necessitates the use of a relatively thicker softenable layer in the imaging members. However, because of rather poor adhesion to the conductive substrates, such as aluminized polyester, of many otherwise excellent softenable materials for migration imaging members, attempts to increase the thickness of the softenable layer to obtain sufficient electrostatic contrast potential often result in film delamination either during manufacture, storage or use.

PRIOR ART STATEMENT

U.S. Pat. No. 4,536,458 to Dominic S. Ng, issued Aug. 20, 1985 —A migration imaging member is disclosed comprising a substrate and an electrically insulating softenable layer on the substrate, the softenable layer comprising migration marking material located at least at or near the surface of the softenable layer spaced from the substrate and a charge transport molecule. The softenable layer may comprise styrene acrylate copolymers, polystyrenes, alkyd substituted polystyrenes, styrene-olefin copolymers, styrene-co-n-hexylmethacrylate, a custom synthesized 80/20 mole percent copolymer of styrene and hexylmethacrylate having an intrinsic viscosity of 0.179 dl/gm; other copolymers of styrene and hexylmethacrylate, styrene-vinyltoluene copolymer, mixtures and copolymers thereof. The migration imaging member is electrostatically charged, exposed to activating radiation in an imagewise pattern and developed by decreasing the resistance to migration of marking material in depth in the softenable layer at least sufficient to allow migration of marking material whereby marking material migrates toward the substrate in image configuration.

U.S. Pat. No. 4,536,457 to Man Tam, issued August 20, 1985 —A process is disclosed in which a migration imaging member comprising a substrate and an electrically insulating softenable layer on the substrate, the softenable layer comprising migration marking material located at least at or near the surface of the softenable layer spaced from the substrate and a charge transport molecule, (e.g. the imaging member described in U.S. Pat. No. 4,536,458), is uniformly charged, and exposed to activating radiation in an imagewise pattern. The resistance to migration of marking material in the softenable layer is thereafter decreased sufficiently to allow slight migration in depth of marking material towards the substrate in image configuration and the resistance to migration of marking material in the softenable layer is further decreased sufficiently to allow non-migrated marking material to agglomerate. The softenable layer may comprise styrene acrylate copolymers, polystyrenes, alkyd substituted polystyrenes, styrene-olefin copolymers, styrene-co-n-hexylmethacrylate, a custom synthesized 80/20 mole percent copolymer of styrene and hexylmethacrylate having an intrinsic viscosity of 0.179 dl/gm; other copolymers of styrene and hexylmethacrylate, styrene-vinyltoluene copolymer, mixtures and copolymers thereof. The migration imaging member may be overcoated with, for example, a water-borne styrene-acrylic copolymer (Neocryl A 622, available from Polyvinyl Chemical Industries).

U.S. Pat. No. 4,496,642 to Man Tam et al, issued Jan. 29, 1985 —A migration imaging member is disclosed comprising a substrate, an electrically insulating softenable layer on the substrate, and a protective overcoating comprising a film-forming resin a portion of which extends beneath the surface of the softenable layer. The softenable layer comprises migration marking material located at least at or near the surface of the softenable layer spaced from the substrate and a charge transport molecule. The softenable layer may also comprise styreneacrylate copolymers, polystyrenes, alkyd substituted polystyrenes, styreneolefin copolymers, styrene-co-n-hexylmethacrylate, a custom synthesized 80/20 mole percent copolymer of styrene and hexylmethacrylate having an intrinsic viscosity of 0.179 dl/gm; other copolymers of styrene and hexylmethacrylate, styrene-vinyltoluene copolymer, mixtures and copolymers thereof. The overcoating may include, for example, a custom synthesized 80/20 mole percent copolymer of styrene and hexylmethacrylate having a weight average molecular weight of about 45,000, or other styrene copolymers, methacrylic copolymers, etc. An overcoating containing a copolymer of styrene and butylmethacrylate (Neocryl A 622, available from Polyvinyl Chemical Industries) is disclosed in Examples I and II. The migration imaging member is electrostatically charged, exposed to activating radiation in an imagewise pattern and developed by decreasing the resistance to migration of marking material in depth in the softenable layer at least sufficient to allow migration of marking material whereby marking material migrates toward the substrate in image configuration.

U.S. Pat. No. 4,391,888 to Change et al—A photoreceptor is disclosed comprising a substrate, a polycarbonate layer, a binder-type charge generating layer and a charge transporting layer. The polycarbonate layer serves both as a charge blocking layer and as an adhesive layer. The molecular weight of the polycarbonate is in the range of 30000 to 40000 and the preferred thickness of the adhesive layer is in the range of 0.1 to 0.2 microns.

U.S. Pat. No. 4,426,435 to Nakayama—A process is disclosed for forming an imaging member consisting of a conductive substrate, an adhesive layer, a photoconductive layer and a protective outer layer of metal oxide dispersed in an organic binder. The adhesive layer is provided between a protective metal oxide outer layer of a photoreceptor and a photoconductive layer. The adhesive layer not only bonds the outer layer to the photoconductive layer, but also serves as a charge injection inhibiting layer. The adhesive layer is made of a polymeric organic compound such as polyester epoxy or polyurethane resin.

U.S. Pat. No. 4,517,271 to Hirooka et al—An electrophotographic photosensitive member is disclosed comprising an aluminum substrate, a photoconductive layer of cadmium sulfide dispersed in an acrylic resin and an insulating protective layer. The cadmium sulfide photoconductive layer is bonded with an acrylic resin so as to stabilize the photoconductive layer. The insulating layer comprises polyethylene, polypropylene, polystyrene or the like is provided to protect the photoconductive layer.

Therefore a shortcoming of many prior art migration imaging members is the delamination of the softenable layer from the underlying substrate when subjected to rigorous handling conditions either during manufacture, storage or use. Another shortcoming of many migration imaging members is the tendency to block under conditions of elevated temperature and pressure during coating, storage and use especially when tightly wound into rolls. Moreover, the xerographic properties of xeroprinting masters prepared from many prior art migration imaging members containing charge transport agents deteriorate when cycled in a xerographic printing system utilizing xerographic liquid developers. These shortcomings are particularly detrimental for migration imaging members that are manipulated under harsh conditions in preparation for and during xeroprinting cycling while the xeroprinting master is in contact with liquid developers.

Thus, there continues to be a need for improved imaging members and processes to overcome the above-noted disadvantages.

SUMMARY OF THE INVENTION

It is an object of the present invention to provide an improved migration imaging member which overcomes the above-noted disadvantages.

It is another object of the present invention to provide a reliable migration imaging member which is mechanically, electrically, chemically and thermally stable, resistant to delamination and blocking and retains its structural integrity and imaging characteristics during manufacture, storage and use.

It is another object of the present invention to provide a reliable migration imaging member which retains its structural integrity and imaging characteristics during manufacture, storage and use, possessing proper viscoelastic properties to be capable of producing excellent either optically sign-retaining or optically sign-reversed images by simply appropriate choice of processing conditions.

It is another object of the present invention to provide a reliable migration imaging member which retains its structural integrity and imaging characteristics during manufacture, storage and use, possessing proper viscoelastic properties to be capable of producing excellent either optically sign-retaining or optically sign-reversed images by simply appropriate choice of processing conditions and without removal of materials from the imaging member, suitable for use as a xeroprinting master, resistant to leaching of charge transport molecules and exhibits extended life when cycled with xerographic liquid developers.

It is another object of the present invention to provide simple and reliable processes for imaging an improved migration imaging member to produce excellent either optically sign-retaining or optically sign-reversed images, suitable for use as a xeropriting master and exhibiting stable xeroprinting properties when cycled with xerographic liquid developers.

These and other objects of the present invention are accomplished by providing an improved migration imaging member comprising a substrate and an electrically insulating softenable layer adjacent the substrate, the softenable layer comprising a fracturable layer of electrically photosensitive migration marking material located substantially at or near the surface of the softenable layer spaced from the substrate, and a copolymer of styrene and ethyl acrylate in at least one layer adjacent the substrate, the copolymer comprising between about 40 and about 80 mole percent styrene, between about 20 and about 60 mole percent ethyl acrylate, the copolymer having a $M_n$ between about 4,000 and about 35,000 a $M_w$ between about 10,000 and about 80,000, a $T_g$ between about 30° C. and about 75° C., and a melt viscosity between about 1—$10^2$ poise and about $1\times10^6$ poise at 115° C.

The copolymer may also have an acid number up to about 25 and comprise between about 0 and about 3 mole percent of a copolymerizable organic acid having carbon-to-carbon unsaturation or derivative thereof having carbon to carbon unsaturation.

The migration imaging member of this invention is utilized in an imaging process comprising providing a migration imaging member comprising a substrate and an electrically insulating softenable layer adjacent the substrate, the softenable layer comprising a fracturable layer of electrically photosensitive migration marking material located substantially at or near the surface of the softenable layer spaced from the substrate, and a copolymer of styrene and ethyl acrylate in at least one layer adjacent the substrate, the copolymer comprising between about 40 and about 80 mole percent styrene, between about 20 and about 60 mole percent ethyl acrylate, the copolymer having a $M_n$ between about 4,000 and about 35,000, a $M_w$ between about 10,000 and about 80,000, a $T_g$ between about 30° C. and about 75° C., and a melt viscosity between about $1\times10^2$ poise and about $1\times10^6$ poise at 115° C.; electrostatically charging the member to deposit a uniform charge on the member; exposing the member to activating radiation in an imagewise pattern prior to substantial decay of the uniform charge; and developing the member by decreasing the resistance to migration of marking material in depth in the softenable layer at least sufficient to allow migration of marking material whereby marking material migrates toward the substrate in image configuration.

The copolymer may also have an acid number up to about 25 and comprise between about 0 and about 3 mole percent of a copolymerizable organic acid having carbon-to-carbon unsaturation or derivative thereof having carbon-to-carbon unsaturation.

Also included within the scope of the present invention is an embodiment where the copolymer of styrene and ethyl acrylate may be in a uniform, continuous adhesive or charge transport spacing layer between the substrate and the softenable layer. In another embodiment, the copolymer of styrene and ethyl acrylate may be in the softenable layer. If desired, the copolymer in any of the aforesaid layers may be a terpolymer of styrene, ethyl acrylate and a copolymerizable organic acid having carbon-to-carbon unsaturation or a copolymerizable derivative of the organic acid. The softenable layer may comprise charge transport materials, the charge transport materials being capable of increasing charge injection from the electrically photosensitive migration marking material to the softenable layer, capable of transporting charge to the substrate and being dissolved or molecularly dispersed in the softenable layer.

Generally, a migration imaging member of this invention may comprise a substrate having an optional conductive layer, an optional adhesive layer, an optional charge transport spacing layer comprising a film forming polymer and a charge transport material, a softenable layer, the softenable layer comprising an optional charge transport material and a fracturable layer of migration marking material contiguous with the upper surface of softenable layer, an optional overcoating layer and a copolymer of styrene and ethylacrylate in the softenable layer, charge transport spacing layer, adhesive layer or combination thereof. The particles of marking material in the fracturable layer do not generally touch each other but are spaced less than a micrometer apart from each other. In the various embodiments, the supporting substrate may be either electrically insulating or electrically conductive. For example, the supporting substrate may be an electrically conductive metal drum or plate. In some embodiments the substrate may comprise a supporting substrate bearing a conductive layer or coating, e.g. an aluminized polyester film, upon which the optional adhesive layer, optional charge transport spacing layer or softenable layer is also coated. The substrate may be opaque, translucent, or transparent in various embodiments, including embodiments wherein the electrically conductive layer coated thereon may itself be partially or substantially transparent. The fracturable layer of marking material contiguous the upper surface of the softenable layer may be slightly, partially, substantially or entirely embedded in the softenable material at the upper surface of the softenable layer.

In another multi-layered embodiment of this invention, the softenable layer may be overcoated with an optional protective overcoating layer. In the various embodiments of the novel migration imaging member of this invention, the overcoating layer may comprise an abhesive or release material or may comprise a plurality of layers in which the outer layer comprises an abhesive or released material.

The migration imaging member of this invention may be imaged to form a xeroprinting master. When employed for xeroprinting masters, the migration imaging member of this invention comprises charge transport material in the softenable layer and in the charge transport spacing layer, if a charge transport spacing layer is employed. The migration imaging member may be imaged to form a xeroprinting master utilizing known migration imaging techniques such as uniform charging, imagewise exposure to activating radiation and development by applying heat, vapor of a solvent or combinations thereof. The resulting xeroprinting master is then uniformly charged by means of a suitable device such as a conventional corotron. The imaging member bearing the deposited uniform charge is then uniformly exposed to activating radiation to form an electrostatic latent image. This electrostatic image may then be toned by conventional xerographic development techniques which transports toner particles charged to a polarity opposite the polarity of charge on the xeroprinting master to form a toner image. The deposited toner image is transferred from the xeroprinting master to a suitable receiving sheet, e.g. paper, by applying a uniform charge to the rear surface of receiving sheet by means of a suitable charging device such as a corotron. Following toner image transfer to a receiving sheet, the transferred toner image may be fixed by well known techniques such as fusing, laminating and the like. The imaging surface of the xeroprinting master may thereafter be cleaned, if desired. The charging, toning, transfering, and cleaning steps may be repeated at high speed. The xeroprinting process thus retains much of the simplicity, stability and quality of conventional xerography, without the need for repeated image exposure. It may not even be necessary to employ a cleaning step, since the same area is toned repeatedly.

In one specific embodiment, a xeroprinting master precursor member comprising an electrically grounded conductive substrate, a softenable layer comprising a copolymer of styrene and ethylacrylate, charge transport material, and a fracturable layer of migration marking material may be uniformly charged with a charge by means of a corona charging means and thereafter imagewise exposed to activating illumination. The xeroprinting master precursor member may then be developed by exposure to solvent vapor followed by heating. Upon application of heat energy to the solvent-treated xeroprinting master precursor member, conversion of the precursor member into a xeroprinting master is completed. Solvent vapour treatment causes the light-exposed particles in the light-exposed areas of fracturable layer of migration marking material to retain a small amount of net charge which allows only slight agglomeration, slight coalescence, slight migration in depth of marking material towards said substrate or combination thereof in image configuration. This results in a $D_{max}$ area. On the other hand, the combination of vapour treatment and heating causes the unexposed particles to substantially agglomerate and coalesce to form relatively few but large agglomerates or spheres. This results in a $D_{min}$ area. Thus, the developed image in the final xeroprinting master is an optically signreversed visible image of an original (if a conventional light-lens exposure system is utilized) exhibiting very low background optical density.

The prepared xeroprinting master can thereafter be utilized in a xeroprinting process. The xeroprinting master may be uniformly charged by a corona charging device. Since the xeroprinting master is uniformly insulating in the dark, there is nothing to cause fringing fields or to defocus the charging ions and the xeroprinting master can be uniformly charged to it full potential over its entire surface. The charged xeroprinting master may then be uniformly flash exposed to light energy to cause the portions of the imaging surface of softenable layer overlying the $D_{max}$ area to substantially discharge and the portions overlying the $D_{min}$ area to retain most of the deposited charge thereby forming an electrostatic latent image. Thus, the uniform charging and subsequent uniform illumination of the xeroprinting master embodiment of this invention cause photodischarge to occur predominantly in the $D_{max}$ region to yield an electrostatic latent image in the xeroprinting master. The electrostatic latent image may then be developed with toner particles to form a toner image corresponding to the electrostatic latent image overlying the $D_{min}$ area. The toner particles having a polarity opposite the polarity of charge on the imagewise pattern of insulating material overlying the $D_{min}$ area are attracted to the oppositely charge portions overlying the $D_{min}$ area (agglomerates or spheres). However, if desired, the toner may be deposited in the discharged areas ($D_{max}$) by employing toner particles having the same polarity as the charged areas ($D_{min}$). The developer will then be repelled by the charges overlying the $D_{min}$ area and deposit in the discharged areas ($D_{max}$ area). Well known electrically biased development electrodes may also be employed, if desired, to direct toner particles to either the charged or the discharged areas of the imaging surface. The deposited toner image may then be transferred to a receiving member, such as paper, by applying an electrostatic charge to the rear surface of the receiving member by means of a suitable corona device. The transferred toner image is thereafter fused by conventional means such as an oven fuser. The developing, transfer and fusing steps are identical to that conventionally used in xerographic imaging.

In another imaging process, a xeroprinting master precursor member comprising an electrically grounded conductive substrate, a softenable layer comprising a copolymer of styrene and ethyl acrylate, charge transport material and a fracturable layer of migration marking material in the softenable layer may be uniformly charged by means of a corona charging means and thereafter imagewise exposed to activating illumination. The light-exposed xeroprinting master precursor member may then be developed by either only heating or only solvent vapour to convert the precursor member into a xeroprinting master. The lightexposed particles in the light-exposed areas of fracturable layer of migration marking material migrate in depth towards the substrate in image configuration, resulting in a $D_{min}$ area. The unexposed particles substantially remain in their original position to result in a $D_{max}$ area. Thus, the developed image in the final xeroprinting master is an optically sign-retaining visible image of an original (if a conventional light-lens exposure system is utilized).

The prepared xeroprinting master can thereafter be utilized in a xeroprinting process. The xeroprinting master may be uniformly charged by a corona charging device and then uniformly flash exposed to light energy to cause the portions of the imaging surface of softenable layer overlying the $D_{max}$ area (unmigrated) to substantially discharge and the portions overlying the $D_{min}$ area (migrated) to retain most of the deposited charge thereby forming an electrostatic latent image. Thus, the uniform charging and subsequent uniform illumination of the xeroprinting master embodiment of this invention cause photodischarge to occur predominately in the $D_{max}$ region of the master. The electrostatic latent image may then be developed with toner particles to form a toner image corresponding to the electrostatic latent image overlying the $D_{min}$ area. The toner particles having a polarity opposite the polarity of charge on the imagewise pattern of insulating material overlying the $D_{min}$ area are attracted to the op positely charged portions overlying the $D_{min}$ area (migrated). However, if desired, the toner may be deposited in the discharged areas ($D_{max}$) by employing toner particles having the same polarity as the charged areas ($D_{min}$). The developer will then be repelled by the charges overlying the $D_{min}$ area and deposit in the discharged areas ($D_{max}$ area). The deposited toner image may then be transferred to a receiving member, such as paper, by applying an electrostatic charge to the rear surface of the receiving member by means of a suitable corona device. The transferred toner image is thereafter fused by conventional means such as an oven fuser. The developing, transfer and fusing steps are identical to that conventionally used in xerographic imaging.

The supporting substrate may be either electrically insulating or electrically conductive. The substrate and the entire xeroprinting master precursor member which it supports may be in any suitable form including a web, foil, laminate or the like, strip, sheet, coil, cylinder, drum, endless belt, endless mobius strip, circular disc or other shape. The present invention is particularly suitable for use in any of these configurations. Typical supporting substrates include aluminized polyester, polyester films coated with transparent conductive polymers, metal plates, drums or the like. In some embodiments the electrically conductive substrate may comprise a supporting substrate having a conductive or layer coating coated onto the surface of the supporting substrate. e.g. an aluminized polyester film, upon which the optional adhesive layer, the optional charge transport spacing layer or softenable layer is also coated. The substrate may be opaque, translucent, or transparent in various embodiments, including embodiments wherein the electrically conductive layer coated thereon may itself be partially or substantially transparent. The conductive layer may be, for example, a thin vacuum deposited metal or metal oxide coating, a metal foil, electrically conductive particles dispersed in a binder and the like. Typical metals and metal oxides include aluminum, indium, gold, tin, oxide, indium tin oxide, silver, nickel, and the like.

The migration imaging member of this invention comprises a substrate and a copolymer comprising styrene and ethyl acrylate in at least one layer overlying the substrate, the copolymer comprising between about 40 and about 80 mole percent styrene, between about 20 and about 60 mole percent ethyl acrylate, the copolymer having a $M_n$ between about 4,000 and about 35,000, a $M_w$ between about 10,000 and about 80,000, a $T_g$ between about 30° C. and about 75° C., and a melt viscosity between about $1\times10^2$ poise and about $1\times10^6$ poise at 115° C. The copolymer may also have an acid number up to about 25 and comprise between about 0 and about 3 mole percent of any suitable copolymerizable organic acid having carbon-to-carbon unsaturation or a copolymerizable derivative of the organic acid having carbon-to-carbon unsaturation. Typical organic acids having carbon-to-carbon unsaturation and derivatives thereof include acrylic acid, methacrylic acid, vinyl acetic acid, itaconic acid, allyl acetic acid, and the like, mixtures thereof, and derivatives thereof. Acrylic acid is particularly preferred as a component of the copolymer because of the greatly improved adhesion of the layer containing the copolymer with the adjacent layer.

This styrene and ethylacrylate copolymer (with or without the copolymerizable organic acid having carbon-to-carbon unsaturation or a copolymerizable derivative thereof) provides excellent resistance to leaching of charge transport molecules to the migration imaging member of this invention when contacted with xerographic liquid developers. Substitution of the styrene or ethylacrylate in the copolymer of this invention with other acrylates such as hexylmethacrylate, butylmethacrylate, acrylate and the like in amount greater than about 10 percent results in substantial loss of the non-leaching properties of the layer containing the charge transport material. Incorporation of acrylic acid or other suitable copolymerizable organic acids having carbon-to-carbon unsaturation and derivatives thereof such as methacrylic acid in the styrene and ethylacrylate copolymer substantially enhances a layer's adhesive properties to the substrate, because of enhanced hydrogen bonding with the oxide surface of metallized substrate such as aluminum oxide of aluminized polyester substrate. The styrene and ethylacrylate copolymer having the range for $M_n$, $M_w$, $T_g$ and melt viscosity defined above provides ideal viscoelastic properties for softening of the softenable layer to readily permit migration of marking particles to form an image, whether the imaging member is developed by heat, or vapor or vapor/heat combination. Additionally, the relatively high $T_g$ of the copolymer is necessary to provide excellent antiblocking property. Any suitable copolymer of styrene and ethyl acrylate having these properties may be employed in the migration imaging member of this invention. Typical copolymers of styrene and ethyl acrylate having these properties include RP1215, available from Monsanto Co. which is believed to be a terpolymer comprising about 74 mole percent styrene, about 25 mole percent ethyl acrylate, and about 1 mole percent acrylic acid, the copolymer having a $M_n$ of about 30,000, a $M_w$ of about 72,000, an acid number of about 8, a $T_g$ of about 65° C., and a melt viscosity about $6\times10^5$ poise at 115° C.; E-335, available from DeSoto Inc. which is believed to be a terpolymer comprising about 48 mole percent styrene, about 50 mole percent ethyl acrylate, about 2 mole percent acrylic acid, the copolymer having a $M_n$ of about 21,000, a $M_w$ of about 54,000, an acid number of about 15, a $T_g$ of about 36° C., and a melt viscosity about $3\times10^3$ poise at 115° C.; E-048, available from DeSoto Inc. which is believed to be a terpolymer comprising about 48 mole percent styrene, about 51 mole percent ethyl acrylate, about 2 mole percent acrylic acid, the copolymer having a $M_n$ of about 26,000, a $M_w$ of about 49,000, an acid number of about 18, and a $T_g$ of about 32° C.; E-351, available from DeSoto Inc. which is believed to be a terpolymer comprising about 48 mole percent styrene, about 50 mole percent ethyl acrylate, about 2 mole percent acrylic acid, the copolymer having a $M_n$ of about 15,000, a $M_w$ of about 52,000, and an acid number of about 18, and a $T_g$ of about 39° C.; a custom synthesized terpolymer comprising about 76 mole percent styrene, about 22 mole percent ethyl acrylate, about 2 mole percent acrylic acid, the copolymer having a $M_n$ of about 27,000, a $M_w$ of about 48,000, an acid number of about 15, a $T_g$ of about 68° C., and a melt viscosity about $3\times10^4$ poise at 115° C.; a custom synthesized copolymer comprising about 73 mole percent styrene, about 27 mole percent ethyl acrylate, about 0 mole percent acrylic acid, the copolymer having a $M_n$ of about 30,000, a $M_w$ of about 52,000, an acid number of about 0, a $T_g$ of about 68° C., and a melt viscosity about $5\times10^4$ poise at 115° C.; a custom synthesized copolymer comprising about 66 mole percent styrene, about 34 mole percent ethyl acrylate, about 0 mole percent acrylic acid, the copolymer having a $M_n$ of about 16,000, a $M_w$ of about 28,000, an acid number of about 0, a $T_g$ of about 60° C., and a melt viscosity about $7\times10^3$ poise at 115° C.; and the like.

The copolymer employed in the imaging system of this invention may be prepared by any suitable well known technique. One typical synthesis process, for example, includes the steps of adding the monomers, styrene, ethyl acrylate and copolymerizable organic acid having carbon-to-carbon unsaturation to a reactor vessel containing a portion of the toluene solvent. These monomers are allowed to equilibrate to the reactor's temperature (70° C.–100° C.) while the system is purged by the bubbling of nitrogen in the monomer solution. The monomer solution is stirred during the purging of the system and during subsequent polymerization. The initiator is added to a second portion of the toluene solvent and is allowed to dissolve or mix with the solvent before it is added to the reaction vessel. The polymerization is then allowed to proceed for five to seven hours while the temperature in the reactor is controlled by cooling.

The layer adjacent to the substrate may be an optional adhesive layer, optional spacing layer or a softenable layer. In order to achieve improved resistance to delamination of the migration imaging members of this invention, the copolymer of styrene and ethyl acrylate should be present in a layer contiguous to and in contact with the underlying substrate. To achieve extended cycling stability when the xeroprinting master is developed with liquid developers which normally cause the charge transport material to leach out of the softenable layer of the xeroprinting master, the copolymer of styrene and ethylacrylate should be present in the softenable layer. In any event, at least one of the layers adjacent to the substrate, i.e. the optional adhesive layer, optional charge transport spacing layer or the softenable layer of the migration imaging member of this invention, must contain the copolymer of styrene and ethylacrylate described above.

As set forth above, when an adhesive layer is employed in an embodiment of the migration imaging member of this invention to provide delamination resistance and blocking resistance to the migration imaging member without degrading the imaging properties of the migration imaging member, the adhesive layer should preferably comprise a terpolymer comprising between about 40 and about 80 mole percent styrene, between about 20 and about 60 mole percent ethyl acrylate, and between about 1 and about 3 mole percent of a copolymerizable organic acid having carbon-to-carbon unsaturation or a copolymerizable derivative of the organic acid having carbon-to-carbon unsaturation, the terpolymer having a $M_n$ between about 10,000 and about 35,000, a $M_w$ between about 25,000 and about 80,000, an acid number up to about 25, a $T_g$ between about 30° C. and about 75° C., and a melt viscosity between about $10^2$ poise and about $10^6$ poise at 115° C. Optimally, the adhesive layer comprises a terpolymer comprising between about 40 and about 80 mole percent styrene, between about 20 and about 60 mole percent ethyl acrylate, and between about 1 and about 3 mole percent of a copolymerizable organic acid having carbon-to-carbon unsaturation or a copolymerizable derivative of the organic acid having carbon-to-carbon unsaturation, the copolymer having a $M_n$ between about 15,000 and about 35,000, a $M_w$ between about 30,000 and about 80,000, an acid number up to about 25, a $T_g$ between about 35° C. and about 75° C., and a melt viscosity between about $5\times10^3$ poise and about $10^6$ poise at 115° C. The preferred range of styrene, ethylacrylate, and molecular weight imparts to the copolymer a sufficiently high $T_g$ so that sufficient blocking resistance is ensured under all practical conditions of manufacture and usage of the imaging member. When a copolymerizable organic acid having carbon-to-carbon unsaturation and derivatives thereof such as acrylic acid, methacrylic acid or other suitable organic acid is combined with the styrene ethylacrylate copolymers to form a terpolymer to provide the excellent adhesive properties of this invention, the amount of copolymerizable organic acid is preferably between about 1 and about 3 mole percent. A slightly lower amount of copolymerizable organic acid may be used at the expense of slightly degraded adhesive strength to the substrate. A somewhat higher amount of copolymerizable organic acid may also be use but the adhesive strength is not further significantly improved. Typical organic acids having carbon-to-carbon unsaturation and derivatives thereof include acrylic acid, methacrylic acid, vinyl acetic acid, itaconic acid, allyl acetic acid, and the like, mixtures thereof, and derivatives thereof. Acrylic acid is particularly preferred as a component of the terpolymer because of the greatly improved delamination resistance and blocking resistance achieved. Although other materials may improve adhesion, some materials, such as a DuPont 49001 polyester adhesive, can cause degradation of imaging properties of the imaging member especially when heat only is used to develop the imaging member. This is because many adhesive materials allow charge injection from the electrode to neutralize the net charge in the migration particles required for migration. This results in substantial increase in $D_{min}$. Additionally the 49001 polyester adhesive exhibits a tendency to block during coating when the coated member is tightly wound into a roll.

Imaging members having the styrene ethylacrylate terpolymer of this invention in the adhesive layer exhibit excellent imaging properties, excellent blocking resistance and have withstood adhesive tape tests and high tension wind-up tests under conditions that were many times more severe than those likely to be encountered during manufacturing and practical usage conditions without damage. The styrene ethylacrylate terpolymer is highly insulating, forms a blocking contact with conductive substrates to prevent charge injection, and is optically transparent and flexible.

When present in an embodiment of the migration imaging member of this invention, the adhesive layer should contain at least about 80 percent by weight, based on the total weight of the adhesive layer, of the terpolymer of styrene ethylacrylate to achieve the excellent imaging, adhesive and anti-blocking properties of this invention. If desired, minor amounts of other suitable materials such as other compatible polymers and the like may be admixed with the terpolymer of styrene and ethylacrylate. Typical materials that may be added to the adhesive layer include, for example, styrene hexylmethacrylate, styrene butylmethacrylate, styrene butadiene and the like. When an adhesive layer is employed, it should form a uniform and continuous layer having a thickness of less than about 1 micrometer and preferably less than about 0.5 micrometer to ensure satisfactory photodischarge if the imaging member is to be used as a xeroprinting master in a xeroprinting process.

A charge transport spacing layer may be included in an embodiment of the migration imaging member of this invention. However, if the migration imaging member is to be imaged to form a xeroprinting master for xeroprinting applications, the optional charge transport spacing layer may be advantageously utilized to maximize the mechanical and xeroprinting properties of the xeroprinting master particularly when a softenable layer material fails to provide the required mechanical properties such as adhesion. The charge transport spacing layer in the xeroprinting master can perform several important functions including transport of the injected charge from the image forming softenable layer to the conducting layer; acting as an interfacial adhesive between the image forming softenable layer and the conductive layer or substrate (if the substrate is conductive and no separate adhesive layer is employed); and increasing spacing between the imaging surface and conductive layer to increase the electrostatic contrast potential of the electrostatic latent image.

The electrostatic contrast potential needed for good quality prints depends on specific kind of developers (for example dry vs. liquid) being used and the development speed required for a particular application. Generally speaking, while a contrast potential in the range of 100–500 volts is adequate for liquid development system, a contrast potential in the range of 200–800 volts is desired for dry toner development system. It should be noted that the electrostatic contrast potential of the electrostatic latent image depends on the combined thickness of the imaging softenable layer and the optional charge transport spacing layer. For dry development system, their combined thickness is generally in the range of from about 4 micrometers to about 30 micrometers, the thickness of the optional charge transport layer being in the range of about 2–25 micrometers. Somewhat thinner layers may be utilized, at the expense of a decrease in print density or slower development speed. Thicker layers may also be used, but further increase in contrast potential does not result in further substantial improvement in image quality. Excellent results are achieved with a combined thickness between about 5 micrometers and about 25 micrometers, the thickness of the optional charge transport spacing layer being in the range of 3–20 micrometers. For liquid development system, their combined thickness is generally in the range of from about 3 micrometers to about 25 micrometers, the thickness of the optional charge transport layer being in the range of 1–20 micrometers. Excellent results are achieved with a combined thickness between about 4 micrometers and about 20 micrometers, the thickness of the optional charge transport spacing layer being in the range of 2–15 micrometers.

Although both the softenable layer and the charge transport layer may contain charge transport material to enable efficient charge transport, the primary role of the charge transport layer is to transport charge and act as a spacing layer while the role of the softenable layer is to both transport charge and to ensure proper charge injection processes between the migration marking material and the softenable layer in the formation of the visible image and in the xeroprinting process. The softenable layer and the charge transport spacing layer may have same or different binder material and/or charge transport material in order to optimize the mechanical, chemical, electrical, imaging and xeroprinting properties of the imaging member. For example, some materials e.g. a styrene/hexylmethacrylate copolymer, exhibits excellent migration imaging properties, but insufficiently flexibility (especially when its thickness is greatly increased to beyond 10 micrometers) and adhesive properties. On the other hand, other materials, e.g. polycarbonate exhibits good flexibility and adhesive properties, but inferior migration imaging properties. Thus by incorporating a separate charge transport spacing layer between the softenable layer and the substrate, one can choose, for example, a 2 micrometers thick styrene/hexylmethacrylate for the softenable layer and a 5 micrometerse thick polycarbonate for the charge transport spacing layer to optimize its imaging, xeroprinting as well as mechanical properties.

In embodiments where the migration imaging member of this invention contains both an adhesive layer and a charge transport spacing layer, the charge transport spacing layer may comprise any suitable film forming binder material. Typical film forming binder materials include styrene acrylate copolymers, polystyrenes, alkyd substituted polystyrenes, styrene-olefin copolymers, styrene-co-n-hexylmethacrylate, a custom syntehsized 80/20 mole percent copolymer of styrene and hexylmethacrylate having an intrinsic viscosity of 0.179 dl/gm; other copolymers of styrene and hexylmethacrylate, styrene-vinyltoluene copolymer, polyalphamethylstyrene, co-polyesters, polyesters, polyurethanes, polycarbonates, co-polycarbonates, mixtures and copolymers thereof. The above group of materials is not intended to be limiting, but merely illustrative of materials suitable for film forming binder material in the optional charge transport spacing layer. The film forming binder material is typically substantially electrically insulating and does not adversely chemically react during the xeroprinting master making and xeroprinting steps of the present invention.

To enhance adhesion in embodiments where the migration imaging member of this invention contains a charge transport spacing layer and no adhesive layer, i.e. the charge transport spacing layer is in contact with the substrate, the charge transport spacing layer should preferably comprise a terpolymer comprising between about 40 and about 80 mole percent styrene, between about 20 and about 60 mole percent ethyl acrylate, and between about 1 and about 3 mole percent copolymerizable organic acid having carbon-to-carbon unsaturation and derivatives thereof, the terpolymer having a $M_n$ between about 10,000 and about 35,000, a $M_w$ between about 25,000 and about 80,000, an acid number up to about 25, a $T_g$ between about 30° C. and about 75° C., and a melt viscosity between about $1\times10^2$ poise and about $1\times10^6$ poise at 115° C. Optimally, the charge transport spacing layer comprises a terpolymer comprising between about 40 and about 80 mole percent styrene, between about 20 and about 60 mole percent ethlacrylate, and between about 1 and about 3 mole percent copolymerizable organic acid having carbon-to-carbon unsaturation and derivatives thereof, the terpolymer having a $M_n$ between about 15,000 and about 35,000, a $M_w$ between about 30,000 and about 80,000, an acid number up to about 25, a $T_g$ between about 35° C. and about 75° C., and a melt viscosity between about $5\times10^3$ poise and about $1\times10^6$ poise at 115° C.

Imaging members having the styrene ethylacrylate terpolymer of this invention in the charge transport spacing layer exhibit excellent resistance to leaching of charge transport molecules when the imaging member is contacted with xerographic liquid developers, as well as excellent blocking resistance and adhesive properties. The styrene ethylacrylate terpolymer is highly insulating, forms a blocking contact with conductive substrates to prevent charge injection, is optically transparent and is flexible.

When a copolymerizable organic acid having carbon-to-carbon unsaturation and derivatives thereof such as acrylic acid, methacrylic acid or other suitable organic acid is combined with the styrene ethylacrylate copolymer to form a terpolymer providing the excellent adhesive properties of this invention, the amount of copolymerizable organic acid is preferably between about 1 and about 3 mole percent. A slightly lower amount of copolymerizable organic acid may be used at the expense of slightly degraded adhesive strength to the substrate. Somewhat higher amounts of copolymerizable organic acid may also be used but the adhesive strength is not further significantly improved. Additionally, a much higher concentration of the copolymerizable organic acid in the charge transport spacing layer may react with the charge transport molecules to form salts, resulting in increased dark charge decay and degraded charge transport properties. Typical organic acids having carbon-to-carbon unsaturation and derivatives thereof include acrylic acid, methacrylic acid, vinyl acetic acid, itaconic acid, allyl acetic acid, and the like, mixtures thereof, and derivatives thereof.

When present in a migration imaging member of this invention, the charge transport spacing layer should contain at least 80 percent by weight, based on the total weight of the charge transport spacing layer, of the copolymer of styrene and ethylacrylate to achieve the excellent imaging, adhesive and anti-blocking properties of this invention. If desired, other suitable materials such as other compatible polymers, other organic acids and the like may be admixed with the terpolymer of styrene and ethylacrylate. Typical materials that may be added to the charge transport spacing layer include, for example, styrene hexylmethacrylate, styrene butylmethacrylate, styrene butadiene and the like.

Charge transport molecules for the charge transport spacing layer are described in greater detail below in the description of the softenable layer. The specific charge transport molecule utilized in the charge transport spacing layer of any given master may be identical to or different from the charge transport molecule employed in the adjacent softenable layer. Similarly, the concentration of the charge transport molecule utilized in the charge transport spacing layer of any given master may be identical to or different from the concentration of charge transport molecule employed in the adjacent softenable layer. When the charge transport material and film forming binder are combined to form the charge transport spacing layer, the amount of charge transport material used may vary depending upon the particular charge transport material and its compatibility (e.g. solubility) in the continuous insulating film forming binder. Satisfactory results have been obtained using between about 10 percent and about 50 percent charge transport material based on the total weight of the optional charge transport spacing layer. Somewhat lower concentration of the charge transport molecule may be used, but may cause increased background potential and cycle-up during xeroprinting because of inefficient charge transport. When the concentration of the charge transport molecule exceeds about 50 percent, crystallization of the charge transport molecules in the charge transport layer may occur and charge dark decay may also be higher. Moreover, very large concentration of the charge transport molecules may also cause the layer to lose its mechanical strength, flexibility and integrity.

The image forming softenable layer is a layer in which images of photoconductive particles are formed. These images comprise the closely spaced monolayer of submicron photosensitive particles embedded just below the surface of a softenable material such as a matrix polymer. The softenable material may optionally also be doped with charge transport materials which may be the same or different from those used in the optional charge transport spacing layer. When the softenable layer contains charge transport materials, the migration imaging member may be used to form a xeroprinting master.

In various modifications of the migration imaging member utilized in the present invention, the migration marking material is preferably electrically photosensitive, photoconductive, or of any of the suitable combination of materials. Typical migration marking materials are disclosed, for example, in U.S. Pat. Nos. 4,536,457, 4,536,458, 3,909,262, and U.S. Pat. No. 3,975,195 the disclosures of these patents being incorporated herein in their entirety. Specific examples of migration marking materials include selenium and selenium-tellurium alloys. The migration marking materials should be particulate and generally closely spaced from each other. The preferred migration marking materials are generally spherical in shape and submicron in size. These spherical migration marking materials are well known in the migration imaging art. Excellent results are achieved with spherical migration marking materials ranging in size from about 0.2 micrometer to about 0.4 micrometer and more preferably from about 0.3 micrometer to about 0.4 micrometer embedded as a sub-surface monolayer in the external surface (surface spaced from the substrate if an overcoating is employed) of the softenable layer. The spheres of the migration marking material are preferably spaced less from each other by a distance of less than about one-half the diameter of the spheres for maximum optical density. The spheres are also preferably from about 0.01 micrometer to about 0.1 micrometer below the outer surface (surface spaced from the substrate if an overcoating is employed) of the softenable layer. An especially suitable process for depositing the migration marking material in the softenable layer is described in U.S. Pat. No. 4,482,622, to P. Soden et al, the disclosure of which is incorporated herein in its entirety. Typical examples of migration marking materials include selenium, selenium-tellurium alloys, other selenium alloys and the like.

In embodiments where the migration imaging member of this invention contains an adhesive layer and/or a charge transport spacing layer, the softenable material may be any suitable material which may be softened by head, solvent vapors or combinations thereof. In addition, in many embodiments, the softenable material is typically substantially electrically insulating and does not chemically react during the migration force applying steps and xeroprinting steps of the present invention. Thus, where the migration imaging member of this invention contains an adhesive layer and/or a charge transport spacing layer, any suitable solvent swellable, softenable material may be utilized in the softenable layer. Typical swellable, softenable materials include styrene acrylate copolymers, polystyrenes, alkyd substituted polystyrenes, styrene-olefin copolymers, styrene-co-n-hexylmethacrylate, a custom synthesized 80/20 mole percent copolymer of styrene and hexylmethacrylate having an intrinsic viscosity of 0.179 dl/gm; other copolymers of styrene and hexylmethacrylate, styrene-vinyltoluene copolymer, polyalphamethylstyrene, copolyesters, polyesters, polyurethanes, polycarbonates, co-polycarbonates, mixtures and copolymers thereof. The above group of materials is not intended to be limiting, but merely illustrative of materials suitable for such softenable layers.

In embodiments where the migration imaging member of this invention is to be utilized in xerographic liquid development processes where the outer surface of the softenable layer contacts xerographic liquid developers that leach out charge transport material from the softenable layer, the softenable layer should preferably comprise a copolymer comprising between about 40 and about 80 mole percent styrene, between about 20 and about 60 mole percent ethyl acrylate, the copolymer having a $M_n$ between about 4,000 and about 35,000, a $M_w$ between about 10,000 and about 80,000, a $T_g$ between about 30° C. and about 75° C., and a melt viscosity between about $1\times10^2$ poise and about $1\times10^6$ poise at 115° C.

The styrene and ethylacrylate copolymer provides the excellent resistance to leaching of charge transport molecules to the migration imaging member of this invention when the imaging member is contacted with xerographic liquid developers, even for many weeks. For xeroprinting applications, it is preferred that the xeroprinting master should be capable of contacting the xerographic liquid developers for at least about 24 hours while, during the contact time, maintaining the concentration of the charge transport molecule in the softenable layer at a level of at least about 90 percent by weight of the original concentration. if the softenable layer loses more than about 10 percent of the charge transport molecule by weight, efficient charge transport may not be maintained, resulting in trapped charge in the softenable layer which may cause cycleup during xeroprinting cycles. Substitution for the styrene or ethylacrylate in the copolymer of this invention by other materials such as hexylmethacrylate, butylmethacrylate etc in amount greater than about 10 percent results in degraded leaching resistance.

If desired, the adhesive properties of the styrene ethylacrylate copolymer may be enhanced by incorporating between about 1 and about 3 mole percent copolymerizable organic acid having carbon-to-carbon unsaturation and derivatives thereof to result in a terpolymer having an acid number put to about 25. Typical organic acids having carbon-to-carbon unsaturation and derivatives thereof include acrylic acid, methacrylic acid, vinyl acetic acid, itaconic acid, allyl acetic acid, and the like, mixtures thereof, and derivatives thereof.

In one specific embodiment, migration imaging members comprising an electrically grounded conductive substrate and image forming softenable layer, the image forming softenable layer containing a fracturable layer of migration marking material and copolymer of styrene and ethylacrylate in the softenable layer, are uniformly charged by means of a corona charging means, imagewise exposed to activating illumination, and developed either by heat only or by solvent vapor only. The light exposed particles in the light exposed areas of fracturable layer of migration marking material migrate in depth of the softenable layer to result in a $D_{min}$ area. The unexposed particles remain substantially in their original positions to result in a $D_{max}$ area. Thus, the developed image is an optically sign-retaining visible image of an original (if a conventional light-lens exposure system is utilized). Preferably, for embodiments where only heat or only solvent vapor is employed to soften the image forming softenable layer to readily allow migration of the migration marking material, the softenable material comprises a copolymer comprising between about 40 and about 80 mole percent styrene, between about 20 and about 60 mole percent ethyl acrylate, and the copolymer having a $M_n$ between about 4,000 and about 35,000, a $M_w$ between about 10,000 and about 55,000, a $T_g$ between about 30° C. and about 75° C., and a melt viscosity between about $1\times10^2$ poise and about $1\times10^5$ poise at 115° C.

If desired, the adhesive properties of the styrene ethylacrylate copolymer may be enhanced by incorporating between about 1 and about 3 mole percent copolymerizable organic acid having carbon-to-carbon unsaturation and derivatives thereof to result in a terpolymer having an acid number up to about 25. Typical organic acids having carbon-to-carbon unsaturation and derivatives thereof include acrylic acid, methacrylic acid, vinyl acetic acid, itaconic acid, allyl acetic acid, and the like, mixtures thereof, and derivatives thereof. To be suitable as a softenable layer material where either heat only or solvent vapor only is employed to soften the softenable layer for migration imaging, the softenable layer material should have a combination of several important properties. In addition to the requirements of good physical properties such as adhesion, blocking resistance, it should have appropriate melt viscosity at the development temperature to readily allow migration of the marking particles to form the migration image. Somewhat higher melt viscosity than that indicated above may be used at the expense of degraded $D_{min}$. For heat-only development processes, the effects of much higher melt viscosity may not be offset by use of much higher development temperature because the migration marking particles usually tend to lose substantially the net charge above about 125° C. Imaging members in which the the image forming softenable layer having styrene ethylacrylate copolymer with the above materials properties exhibit excellent optically sign-retaining images, blocking resistance and adhesive properties. Furthermore the imaging members exhibit excellent resistance to the leaching of the charge transport molecules from the softenable layer when contacted with xerographic liquid developers even for a long period of time.

In another development process embodiment of this invention, migration imaging members comprising an electrically grounded conductive substrate and image forming softenable layer, the image forming softenable layer containing charge transport molecules and a fracturable layer of migration marking material and copolymer of styrene and ethylacrylate in the softenable layer, are uniformly charged by means of a corona charging means, imagewise exposed to activating illumination, and exposed to solvent vapor. Upon application of heat energy to the solvent vapor treated migration imaging member, conversion of the member into an imaged member is completed. The light exposed particles in the light exposed areas of fracturable layer of migration marking material retain a slight amount of net charge which allows only slight agglomeration and coalescence and/or which allows only slight migration. This results in a $D_{max}$ area. The unexposed particles substantially agglomerate and coalesce to form a relatively few but large agglomerates or spheres to result in a $D_{min}$ area. Thus, the developed image is an optically sign-reversed visible image of an original (if a conventional light-lens exposure system is utilized), exhibiting very low background density. This process is described in U.S. Pat. No. 4,536,457 to M. C. Tam, the entire disclosure of which is incorporated herein by reference. Preferably, for embodiments utilizing a combination of solvent vapor and heating to soften the image forming softenable layer to allow formation of migration image, the softenable material comprises a copolymer comprising between about 40 and about 80 mole percent styrene, between about 20 and about 60 mole percent ethyl acrylate, the copolymer having a $M_n$ between about 10,000 and about 35,000, a $M_w$ between about 25,000 and about 80,000, a $T_g$ between about 30° C. and about 75° C., and a melt viscosity between about $1\times10^2$ poise and about $1\times10^6$ poise at 115° C. If desired, the adhesive properties of the styrene ethylacrylate copolymer may be enhanced by incorporating between about 1 and about 3 mole percent copolymerizable organic acid having carbon-to-carbon unsaturation and derivatives thereof to result in a terpolymer having an acid number up to about 25. Typical organic acids having carbon-to-carbon unsaturation and derivatives thereof include acrylic acid, methacrylic acid, vinyl acetic acid, itaconic acid, allyl acetic acid, and the like, mixtures thereof, and derivatives thereof. Imaging members in which the image forming softenable layer comprises styrene ethylacrylate copolymer with the above materials properties exhibit excellent optically sign-reversed images, blocking resistance and adhesive properties. Furthermore the imaging members exhibit excellent resistance to the leaching of the charge transport molecules from the softenable layer when contacted with xerographic liquid developers even for a long period of time.

Most preferred, for all development embodiments including those where only heat or only solvent vapor or a combination of solvent vapour and heat are employed to soften the image forming softenable layer to readily allow migration of the migration marking material, the softenable material preferably comprises a copolymer comprising between about 40 and about 80 mole percent styrene, between about 20 and about 60 mole percent ethyl acrylate, the copolymer having a $M_n$ between about 4,000 and about 35,000, a $M_w$ between about 10,000 and about 80,000, a $T_g$ between about 30° C. and about 75° C., and a melt viscosity between about $1\times10^2$ poise and about $1\times10^6$ poise at 115° C. If desired, the adhesive properties of the styrene ethylacrylate copolymer may be enhanced by incorporating between about 1 and about 3 mole percent copolymerizable organic acid having carbon-to-carbon unsaturation and derivatives thereof to result in a terpolymer having an acid number up to about 25. Typical organic acids having carbon-to-carbon unsaturation and derivatives thereof include acrylic acid, methacrylic acid, vinyl acetic acid, itaconic acid, allyl acetic acid, and the like, mixtures thereof, and derivatives thereof. These parameters provide ideal viscoelastic properties permitting migration imaging of the electrically photosensitive migration marking particles, such as selenium particles to form an image; resistance to leaching of charge transport material in liquid developers; enhancement of adherence of softenable layers to underlying substrates such as aluminized polyester; and enhancement of blocking resistance under conditions of elevated temperature and pressure during coating, storage, and the like.

Generally, when the copolymer of styrene and ethylacrylate is employed in the image forming softenable layer of a migration imaging member of this invention, the image forming softenable layer should contain at least 80 percent by weight, based on the total weight of the image forming softenable layer, of the copolymer of styrene and ethylacrylate to achieve the excellent imaging, adhesive and anti-blocking properties of this invention. If desired, other suitable materials such as other compatible polymers may be admixed with the terpolymer of styrene and ethylacrylate. Typical materials that may be added to the adhesive layer include, for example, styrene hexylmethacrylate, styrene butylmethacrylate, styrene butadiene and the like. If the imaging member is to be contacted with xerographic liquid developers, the image forming softenable layer should contain at least 90 percent by weight, based on the total weight of the image forming softenable layer, of the copolymer of styrene and ethylacrylate to avoid substantial loss of its leaching resistance.

Charge transport material may be optionally incorporated into the image forming softenable layer of the migration imaging member of this invention, particularly if the imaging member is used to form a xeroprinting master. Any suitable charge transport material capable of acting as a softenable layer material or which is soluble or dispersible on a molecule scale in the softenable layer material may be utilized in the softenable layer of this invention. The charge transport material is defined as an electrically insulating film-forming binder or a soluble or molecularly dispersible material dissolved or molecularly dispersed in an electrically insulating film-forming binder which is capable of improving the charge injection process (for at least one sign of charge) from the marking material into the softenable layer (preferably prior to, or at least in the early stages of, development by softening of the softenable layer), the improvement being by reference to an electrically inert insulating softenable layer. The charge transport materials may be hole transport materials and/or electron transport materials, that is they may improve the injection of holes and/or electrons from the marking material into the softenable layer. Where only one polarity of injection is improved, the sign of ionic charge used to initially sensitize the migration marking member to light for the purposes of this invention is most commonly the same as the sign of charge whose injection is improved. The selection of a combination of a specific transport material with a specific marking material should therefore be such that the injection of holes and/or electrons from the marking material into the softenable layer is improved compared to a softenable layer which is free of any transport material. Where the charge transport material is to be dissolved or molecularly dispersed in an insulating film-forming binder, the combination of the charge transport material and the insulating film-forming binder should be such that the charge transport material may be incorporated into the film-forming binder in sufficient concentration levels while still remaining in solution or molecularly dispersed. Any suitable charge transporting material may be used. Charge transporting materials are well known in the art. Typical charge transporting materials include the following:

Diamine transport molecules of the types described in U.S. Pat. Nos. 4,306,008, 4,304,829, 4,233,384, 4,115,116, 4,299,897 and 4,081,274. Typical diamine transport molecules include N,N'-diphenyl-N,N'-bis(3''-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4-4,-diamine, N,N'-diphenyl-N,N'-bis(phenylmethyl)-[1,1'-biphenyl]-4-4,-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphyenyl]-4-4'-diamine, N,N'-diphenyl-N,N'-bis(4-methylphenyl)-[2,2'-dimethyl-1,1'biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl-[2,2'-dimethyl-1,1'-biphenyl]-4,4'-diamine, N,N'-diphenyl-N,N'bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, and U.S. Pat. No. 3,837,851. Typical pyrazoline transport molecules include 1-[lepidyl-(2)[-3-(p-diethylaminophenyl)-5-(p-diethylaminophenyl)pyrazoline, 1-[quinolyl-(2)]-3-(p-diethylaminophyenyl)-5-(p-diethylaminophenyl)-pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl) pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene,2-nitro-9-(4'-diethylaminobenzylidene)fluorene and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Pat. Nos. 1,058,836, 1,060,260 and 1,120,875.

Hydrazone transport molecules such as p-diethylamino benzaldehyde-(diphenyl hydrazone)), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthalene-1-carbaldehyde 1-methyl-1-phenylhydrazone and the like. Other typical hydrazone transport molecules described for example, in U.S. Pat. Nos. 4,150,987, 4,385,106, 4,338,388 and U.S. Pat. No. 4,387,147.

Carbazole phenyl hydrazone transport molecules such as 9-ethylcarbazole-3-carboaldehyde-1-methyl-1-phenyl hydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described in U.S. Pat. No. 4,256,821 and U.S. Pat. No. 4,297,426.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butyl-naphthalimide as described in U.S. Pat. No. 3,972,717.

Oxadiazole derivatives such as 2,5-bis-(p-diethylaminophenyl)oxadiazole-1,3,4 described in U.S. Pat. No. 3,895,944.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989.

9-fluorenylidene methane derivatives having the formula: wherein X and Y are cyano groups or alkoxycarbonyl groups, A, B, and W are electron withdrawing groups independently selected from the group consisting of acyl, alkoxycarbonyl, nitro, alkylaminocarbonyl and

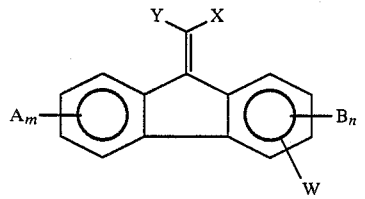

derivatives thereof, m is a number of from 0 to 2, and n is the number 0 or 1 as described in copending in U.S. Pat. No. 4,474,865. Typical 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like.

Other charge transport materials include as poly-1-vinylpyrene, poly-9-vinylanthracene, poly-9-(4-pentenyl)-carbazole, poly-9-(5-heyxl)carbazole, polymethylene pyrene, poly-1-(pyrenyl)butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric or non-polymeric transport materials as described in U.S. Pat.No. 3,870,516.

The disclosures of each of the patents identified above pertaining to charge transport molecules which are soluble or dispersible on a molecular scale in a film forming binder are incorporated herein in their entirety.

When the charge transport materials are combined with an insulating binder to form the softenable layer, the amount of charge transport material which is used may vary depending upon the particular charge transport material and its compatibility (e.g. solubility) in the continuous insulating film forming binder phase of the softenable layer and the like. Depending on the specific imaging system used, including the specific imaging structure, materials, process steps, and other parameters, satisfactory results may be obtained using between about 0 percent to about 50 percent by weight charge transport material based on the total weight of the softenable layer. For xeroprinting masters, satisfactory results are obtained using between about 8 percent to about 50 percent by weight charge transport material based on the total weight of the softenable layer. A particularly preferred charge transport molecules is one having the general formula:

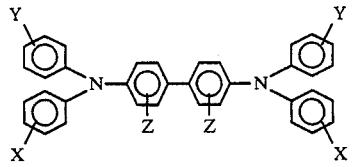

wherein X, Y and Z are selected from the group consisting of hydrogen, an alkyl group having from 1 to about 20 carbon atoms and chlorine and at least one of X, Y and Z is independently selected to be an alkyl group having from 1 to about 20 carbon atoms or chlorine. If Y and Z are hydrogen, the compound may be named N,N'-bis(alkylphenyl)-[1,1'-biphenyl]-4,4'-diamine wherein the alkyl is, for example, methyl, ethyl, propyl, n-butyl, etc. or the compound may be N,N'-diphenyl-N,N'-bis(chlorophenyl)-[1,1'-biphenyl]-4,4'-diamine.

When a combination of vapor and heating is used to develop the imaging member, excellent results, including exceptional storage stability, may be achieved when the softenable layer contains between about 10 percent to about 40 percent by weight of these diamine compounds based on the total weight of the softenable layer. Optimum results are achieved when the softenable layer contains between about 16 percent to about 40 percent by weight of N,N'-diphenyl-N,N'-bis(3''-methylphenyl)-(1,1'-biphenyl)(-4,4'-diamine based on the total weight of the softenable layer. When the softenable layer contains less than about 8 percent by weight of these diamine compounds based on the total weight of the softenable layer, $D_{min}$ becomes noticeably higher and because of inefficient charge transport, electrostatic contrast potential for xeroprinting is reduced. When the softenable layer contains more than about 50 percent by weight of these diamine compounds based on the total weight of the softenable layer, the mechanical strength, flexibility and integrity of the softenable layer are somewhat degraded and charge dark decay may become also higher. Moreover, very large concentrations of these diamine compounds may cause crystallization of the compounds in the softenable layer.

When either heat only or vapor only is used to develop the imaging member, excellent results may be achieved when the softenable layer contains between about 10 percent to about 40 percent by weight of these diamine compounds based on the total weight of the softenable layer. Optimum results are achieved when the softenable layer contains between about 16 percent to about 40 percent by weight of N,N'-diphenyl-N,N'-bis(3''-methylphenyl)-(1,1'-biphenyl)-4,4'-diamine based on the total weight of the softenable layer.

The charge transport material may be incorporated into the softenable layer and the optional charge transport spacing layer by any suitable technique. For example, it may be mixed with the softenable layer or spacing layer components by dissolution in a common solvent. If desired, a mixture of solvents for the softenable or spacing layer may be used to facilitate mixing and coating.

The optional adhesive layer, optional charge transport spacing layer and softenable layer may be applied to the substrate by any conventional coating process. In the coating of these multi-layers, appropriate measures should be taken to ensure that coating of one layer does not result in dissolution of the underlying layer. This can be accomplished by appropriate choice of the film-forming binder materials and their solvent or mixture of solvents. Typical coating processes include draw bar, spraying, extrusion, dip, gravure roll, wire wound rod, air knife coating and the like. The thickness of the adhesive and charge transport spacing layers have been discussed above. The thickness of the deposited softenable layer depends on the intended applications of the final image. Where the ultimate goal is solely to create a visible image on the imaging member, the thickness of the softenable layer is generally in the range of 1–3 micrometers.

However if the imaged member is to be used for xeroprinting, the thickness of the softenable layer depends on whether a charge transport spacing layer is used or not. If a charge transport spacing layer having a thickness in the range of 1–25 micrometers is used, the thickness of the deposited softenable layer after any drying or curing step is preferably in the range of about 2–5 micrometers to provided a combined thickness in the range of about 3–30 micrometers. Thickness less than 2 micrometers for the softenable layer may result in insufficient electrostatic contrast potential for development of the latent image during xeroprinting. The use of a charge transport layer renders the use of a softenable layer thicker than about 5 micrometers unnecessary,. However if a charge transport layer is not used, the thickness of the softenable layer is preferably in the range of about 3–30 micrometers to give sufficiently high electrostatic contrast potential to suit a particular application. Layers thicker than about 30 micrometers may also be utilized, but do not give further improvement in print quality.

Incorporation of the charge transport material into the softenable layer and the charge transport layer imparts to the imaging member of the present invention the ability to form either optically signreversed images or optically sign-retaining images and enhances their usefulness as a xeroprinting master.

For migration imaging member development systems utilyzing solvent pretreatment followed by heat, other factors should be considered. Any suitable solvent for the softenable material in the softenable layer may be employed. Upon contact, the solvent should soften the softenable layer sufficiently to allow the exposed migration marking material to retain a slight net charge to prevent agglomeration and to allow no more than slight migration in depth of migration marking material towards the substrate in image configuration, and upon further decreasing the resistance to migration of marking material in the softenable layer to allow non-exposed marking material to agglomerate and coalesce. Typical solvents includes various ketones, aliphatic esters, halogenated aliphatics and their mixtures. Softening of the softenable layer sufficiently to allow slight migration in depth of migration marking material towards the substrate in image configuration may be effected by contact with vapors or liquids of solvents or mixtures of solvent. If desired, the mixtures of solvents may comprise a mixture of poor solvents and good solvents for the softenable material to control the degree of softening of the softenable material within a given period of time. Typical combinations of softenable materials and solvents or combinations of solvents include styrene ethylacrylate copolymer and methyl ethyl ketone solvent, styrene hexylmethacrylate copolymer and methyl ethyl ketone solvent, styrene hexylmethacrylate copolymer and ethyl acetate solvent, styrene hexylmethacrylate copolymer and di-ethyl ketone solvent, styrene hexylmethacrylate copolymer and methylene chloride solvent, styrene butymethacrylate and 1,1,1 trichlorethane solvent, styrene hexylmethacrylate copolymer and mixture of toluene and isopropanol solvents, styrene butadiene copolymer and mixture of ethyl acetate and butyl acetate solvents. If an optional overcoating layer is used on top of the softenable layer to improve abrasion resistance, the overcoating layer should be permeable to the vapor of the solvent used and additional vapor treatment time should be allowed so that the solvent vapour can soften the softenable layer sufficiently to allow the exposed migration marking material to retain a slight net charge and to allow no more than slight migration in depth of migration marking material towards the substrate in image configuration, and upon further decreasing the resistance to migration of marking material in the softenable layer to allow non-exposed marking material to agglomerate and coalesce.

The optional overcoating layer may be substantially electrically insulating, or have any other suitable properties. The overcoating should be substantially transparent, at least in the spectral region where electromagnetic radiation is used for imagewise exposure step in the imaging process and for the uniform exposure step in the xeroprinting process. The overcoating layer is continuous and preferably of a thickness up to about 1–2 micrometers. Preferably, the overcoating should have a thickness of between about about 0.1 micrometer and about 0.5 micrometer to minimize residual charge buildup. Overcoating layers greater than about 1 to 2 micrometers thick may also be used, but may cause cycle-up when multiple prints are made during xeroprinting because of the tendency of charge trapping to occur in the bulk of the overcoating layer. Typical overcoating materials include acrylic-styrene copolymers, methacrylate polymers, methacrylate copolymers, styrenebutylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer should protect the softenable layer in order to provide greater resistance to the adverse effects of abrasion during handling, imaging and xeroprinting. The overcoating layer preferably adheres strongly to the softenable layer to minimize damage. The overcoating layer may also have abhesive properties at its outer surface which provide improved resistance to toner filming during toning, transfer and/or cleaning. The abhesive properties may be inherent in the overcoating layer or may be imparted to the overcoating layer by incorporation of another layer or component of abhesive material. These abhesive materials should not degrade the film forming components of the overcoating and should preferably have a surface energy of less than about 20 ergs/cm$^2$. Typical abhesive materials include fatty acids, salts and esters, fluorocarbons, silicones and the like. The coatings may be applied by any suitable technique such as draw bar, spray, dip, melt, extrusion or gravure coating. It will be appreciated that these overcoating layers protect the xeroprinting master before imaging, during imaging, after the members have been imaged, and during xeroprinting.

The imaging steps in the process of using the imaging members of the present invention in one embodiment comprise the steps of forming an electrical latent image on the imaging member and developing the latent image by decreasing the resistance of the softenable material to allow migration of the particulate marking material through the softenable layer whereby migration marking material is allowed to migrate in depth in softenable material layer in an imagewise configuration.

An electrical latent image may be formed on the imaging member by uniformly electrostatically charging the member and then exposing the charged member to activating electromagnetic radiation in an imagewise pattern prior to substantial dark decay of said uniform charge. Satisfactory results may be obtained if the dark decay is less than about 50 percent of the initial charge, thus the expression "substantial decay" is intended to mean a dark decay is less than 50 percent of the initial charge. A dark decay of less than about 25 percent of the initial charge is preferred for optimum imaging. Where an imaging member of the present invention comprises a substrate having conductive coating thereon, a softenable layer, a fracturable layer of marking material contiguous the surface of the softenable layer and a copolymer of styrene and ethylacrylate in the softenable layer is electrostatically charged with a corona charging device, the conductive coating may be grounded or maintained at a predetermined potential during electrostatic charging. The charged member is exposed to activating electromagnetic radiation in an imagewise pattern thereby forming an electrical latent image upon the imaging member. The member having the electrical latent image thereon is then developed by decreasing the resistance of the softenable material to allow migration of the particulate marking material through the softenable layer by, for example, application of heat radiating into the softenable material to effect softening. The application of heat or, solvent vapors, or combinations thereof, or any other suitable means for decreasing the resistance of the softenable material of softenable layer may be utilized to develop the latent image by allowing migration marking material to migrate in depth in the softenable layer in imagewise configuration. In embodiments where the softenable layer contains an optional charge transport material and where heat is used for development, the migration marking material migrates in depth in the softenable layer in areas corresponding to the exposed region and remain in its initial, unmigrated state in areas corresponding to the unexposed region. An overcoating layer may be applied to protect the imaging member prior to, during and after imaging.

During the heat development step, the imaging member is typically developed by uniformly heating the structure to a relatively low temperature. For example, at a temperature of 110° C. to about 130° C., heat need only be applied for a few seconds for softenable layers containing a 80/20 styrene hexylmethacrylate copolymer having a melt viscosity of about $10^4$ poise at 115° C. For lower heating temperatures, more heating time may be required. When the heat is applied, the softenable layer decreases in viscosity thereby decreasing its resistance to migration of the marking material in depth through the softenable layer in the exposed areas.

If desired, solvent vapor development may be substituted for the heat development step. Vapor development of migration imaging members is well known in the art. A preferred solvent utilized for solvent vapor development is toluene with vapor exposure for between about 4 seconds and about 60 seconds at a solvent vapor partial pressure of between about 5 millimeters and 30 millimeters of mercury.

The developed migration imaging member may be utilized as a xeroprinting master in a xeroprinting process where the xeroprinting master is uniformly charged by a suitable means such as by corona charging. The polarity of corona charging to be used in the xeroprinting process is determined by whether hole transport materials or electron transport materials are incorporated into the softenable layer and the charge transport spacing layer. Positive corona charging is used with hole transport material in the softenable layer and the charge transport spacing layer. When electron transport material is used in the softenable layer and the charge transport spacing layer, the xeroprinting master is uniformly charged negatively. Although charging has been described in connection with corona charging, it is to be understood that this is exemplary only and charging may be achieved with any other suitable technique. Other charging methods include friction charging and induction charging as described in U.S. Pat. Nos. 2,934,649 and 2,833,930 and roller charging as described in U.S. Pat. No. 2,934,650.

The charged xeroprinting master is then uniformly exposed to activating radiation to form an electrostatic latent image. Depending upon the specific imaging system used, including the specific imaging structures, materials, process steps, and other parameters, the imaging member of the present invention may produce positive images from positive originals or negative images from positive originals. For example, migration imaging members containing charge transport material in the softenable layer can be developed by exposure to solvent vapor followed by heating to produce an optically sign-reversed image on the xeroprinting master. In the unexposed region, the migration marking particles agglomerate and coalesce to form relatively few and large particles, resulting in a $D_{min}$ area. In the light-exposed region, the migration marking particles retain a small net charge which allows only slight agglomeration, slight coalescence, slight migration in depth of marking material towards said substrate or combination thereof to result in a $D_{max}$ area. Because of the difference in size and number of the migration particles in the $D_{max}$ and $D_{min}$ areas, the rate of photodischarge and the extent of photodischarge in the $D_{max}$ and $D_{min}$ areas are greatly different. When this xeroprinting master is uniformly charged and then uniformly exposed to activating electromagnetic radiation, photodischarge occurs predominantly in the $D_{max}$ area and substantially less photodischarge occurs in the $D_{min}$ area of the xeroprinting master, resulting in an electrostatic latent image. The activating electromagnetic radiation used for the uniform exposure step should be in the spectral region where the migration marking particles photogenerate charge carriers. Monochromatic light in the region of 300–500 nanometers is preferred for selenium particles to maximize the electrostatic contrast potential of the electrostatic latent image. The exposure energy should be such that the desired and/or optimal electrostatic contrast potential is obtained. Thus, in this embodiment, while the visible image on the xeroprinting master is an optically negative image of the positive original (if the master is created by lens coupled exposure instead of laser scanning), the electrostatic charge pattern is a positive (sign-retaining image) of the original image.

In another imaging process, migration imaging members containing charge transport material in the softenable layer may also be developed by the application of either heat only or solvent vapor only to produce an optically sign-retaining image on the xeroprinting master. In the unexposed region, the migration marking particles remain substantially in their initial position to result in a $D_{max}$ area. In the light-exposed region, the migration marking particles migrate in depth to become dispersed in the softenable layer, resulting in a $D_{min}$ area. The rate of photodischarge and the extent of photodischarge between the $D_{max}$ and $D_{min}$ areas are greatly different because of the difference in locations and distribution of the migration particles in the $D_{max}$ and $D_{min}$ areas. When this xeroprinting master is uniformly charged and then uniformly exposed to activating electromagnetic radiation, photodischarge occurs predominantly in the $D_{max}$ area and substantially less photodischarge occurs in the $D_{min}$ area of the xeroprinting master, resulting in an electrostatic latent image. In this embodiment, while the visible image on the xeroprinting master is an optically sign-retaining image, i.e. positive image of the positive original (if the master is created by lens coupled exposure instead of laser scanning), the electrostatic charge pattern is an optically sign-reversed, i.e. negative of the original image.

The electrostatic latent image is then developed with toner particles to form a toner image corresponding to the electrostatic latent image. The developing (toning) step is identical to that conventionally used in xerographic imaging. Any suitable conventional xerographic dry or liquid developer containing electrostatically attractable marking particles may be employed to develop the electrostatic latent image on the xeroprinting masters of this invention. Typical dry toners have a particle size of between about 6 micrometers and about 20 micrometers. Typical liquid toners have a particle size of between about 0.1 micrometers and about 3 micrometers. Dry toners are disclosed, for example, in U.S. Pat. Nos. 2,788,288, 3,079,342 and U.S. Pat. No. 25,136. Liquid developers are disclosed, for example, in U.S. Pat. Nos. 2,890,174 and 2,899,335. The size of toner particles affect the resolution of prints. For applications demanding very high resolution such as in color proofing and printing, liquid toners are generally preferred because their much smaller toner particle size which gives better resolution of fine half-tone dots and produce four color images without undue thickness in dense black areas. Transferrable liquid developed toners are typically about 2 micrometers in diameter.

This invention is particularly advantageous for development with xerographic liquid developers. Liquid developers may comprise aqueous base or oil based inks. This includes both inks containing a water or oil soluble dye substance and the pigmented inks. Typical dye substances are Methylene Blue, commercially available from Eastman Kodak Company, Brilliant Yellow, commercially available from the Harlaco Chemical Co., potassium permanganate, ferric chloride and Methylene Violet, Rose Bengal and Quinoline Yellow, the latter three available from Allied Chemical Company, and the like. Typical pigments are carbon black, graphite, lamp black, bone black, charcoal, titanium dioxide, white lead, zinc oxide, zinc sulfide, iron oxide, chromium oxide, lead chromate, zinc chromate, cadmium yellow, cadmium red, red lead, antimony dioxide, magnesium silicate, calcium carbonate, calcium silicate, phthalocyanines, benzidines, naphthols, toluidines, and the like. The liquid developer composition may comprise a finely-divided opaque powder, a high resistance liquid and an ingredient to prevent agglomeration. Typical high resistance liquids include such organic dielectric liquids as Isopar, carbon tetrachloride, kerosene, benzene, trichloroethylene, and the like. Other developer components or additives include vinyl resins, such as carboxy vinyl polymers, polyvinylpyrrolidones, methylvinylether maleic anhydride interpolymers, polyvinyl alcohols, cellulosics such as sodium carboxy-ethylcellulose, hydroxypropylmethyl cellulose, hydroxyethyl cellulose, methyl cellulose, cellulose derivatives such as esters and ethers thereof, alkali soluble proteins, casein, gelatin, and acrylate salts such as ammonium polyacrylate, sodium polyacrylate, and the like.

Any suitable conventional xerographic development technique may be utilized to deposit the toner particles on the electrostatic on the imaging surface of the xeroprinting masters of this invention. Well known xerographic development techniques include, magnetic brush, powder cloud, cascade, liquid and the like development processes. Cascade development is more fully described in U.S. Pat. Nos. 2,618,551 and 2,618,552, powder cloud development is more fully described in U.S. Pat. Nos. 2,725,305 and 2,918,910, magnetic brush development is more fully described in U.S. Pat. Nos. 2,791,949 and 3,015,305, and liquid development is more fully described in U.S. Pat. No. 3,084,043. All of these toner, developer and development technique patents are incorporated herein in their entirety. When it is desired that the developed image comprise an image developed corresponding to the areas of charge, it is generally preferred to pass in contact therewith a developer which is triboelectrically charged to a polarity opposite to the retained charge of the latent image whereby the developer is attracted and adheres to the charged areas of the insulative image pattern. However, when it is preferred that a developed image corresponding to the uncharged areas be reproduced, it is the general practice to employ developer charged to the same polarity as the image charge pattern. The developer will then be repelled by the charges of the latent image and will deposit on the non-charged areas of the plate with the charged areas remaining absent of developer.

Any suitable means may be used to transfer the developed image from the surface of the xeroprinting master to the transfer or copy sheet representing the final copy. A particularly useful and generally preferred method of carrying out the transfer operation comprises an electrostatic transfer technique wherein a transfer sheet is placed in contact with the image bearing surface or xeroprinting surface and an electric charge applied to the reverse side of the transfer sheet by, for example, an adjacent ion source such as a corona discharge electrode or other similar device placed in juxtaposition to the transfer member. Such an ion source may be similar to the source employed during a charging step of the xeroprinting process and is maintained at a high electrical potential with respect to the image bearing. Corona discharge occurs resulting in the deposition on the transfer sheet of ionized particles which serve to charge the member. The transfer member will be charged to a polarity opposite to that of the developed image and strong enough to overcome the potential initially applied to the surface of the xeroprinting master. A single wire corotron having applied thereto a potential of between about 5000 and about 8000 volts provides satisfactory transfer. Adhesive pickoff is another form of image transfer that may be used. The electrostatic transfer process is preferred in order to obtain maximum image transfer while retaining high image resolution. When liquid developers are employed a more generally preferred method of image transfer is that of applying contact pressure when the transfer member is brought into surface contact with the developed image.

Any suitable material may be used as the transfer or receiving sheet for the developed image during the xeroprinting process. The copy material may be insulating in nature or partially conductive. Typical materials are polyethylene, polyvinylchloride, polyvinylfluoride, polypropylene, polyethylene terephthalate, and ordinary bond paper.

The image transferred to the surface of the transfer or receiving sheet may be fixed to its support by any suitable means such as vapor fusing, heated roll fusing, flash fusing, or oven fusing of the developed image with a regulated amount of heat or by a lamination process. It is preferred to use the heat fixing technique in conjunction with toner developed images inasmuch as it allows for a high degree of control of the fixing phase of the process. When liquid developers have been used fixing is achieved by allowing for the evaporation of the relatively volatile carrier fluids utilized. Thus, the fixing step may be identical to that conventionally used in xerographic imaging.

Since the xeroprinting master produces identical successive images in precisely the same areas, it may not be necessary to erase the electrostatic latent image between successive imaging cycles. However, if desired, the master may optionally be erased by conventional xerographic erasing techniques. For example, uniform exposure of the xeroprinting master to a strong light will discharge both the image and non-image areas of the master. Typical light intensities useful for erasure range from about 10 times to about 300 times the light intensities used for the uniform exposure step. Another well known technique involves exposing the imaging surface to AC corona discharge to neutralize any residual charge on the master. Typical potentials applied to the corona wire of an AC corona erasing device may range from about 5 kilovolts and about 10 kilovolts.

If desired, the imaging surface of the xeroprinting master may be cleaned. Any suitable cleaning step that is conventionally used in xerographic imaging may be employed for cleaning the xeroprinting master of this invention. Typical, well known xerographic cleaning techniques include brush cleaning, web cleaning, and the like.

After transfer of the deposited toner image from the master to a receiving member, the master may, with or without erase and cleaning steps, be cycled through additional uniform charging, uniform illumination, development and transfer steps to prepare additional imaged receiving members.

The migration imaging members of this invention include embodiments that are resistant to leaching of charge transport molecules from the softenable layers. The migration imaging members of this invention also include embodiments that exhibit superior adhesion of layers to the substrate thereby avoiding delamination during manufacturing, storage and use. For embodiments in which the outer layer comprises the styrene ethylacrylate copolymer, the migration imaging members of this invention may be tightly coiled without blocking. Incorporation of the styrene ethylacrylate copolymer into one or more layers of the migration imaging members of this invention can be effected without adversely affecting the mechanical, thermal, chemical and electrical properties of the imaging members.

The invention will now be described in detail with respect to specific preferred embodiments thereof, it being noted that these examples are intended to be illustrative only and are not intended to limit the scope of the present invention. Parts and percentages are by weight unless otherwise indicated.

EXAMPLE I

A 50 percent by weight toluene solution of styrene ethylacrylate acrylic acid terpolymer resin (RP-1215, available from Monsanto Co.) was diluted with toluene to give a 5 percent (by total weight) solution. The styrene ethylacrylate acrylic acid terpolymer resin had the following properties: 74 mole percent styrene, 25 mole percent ethyl acrylate, 1 mole percent acrylic acid, a $M_n$ of $30\times10^3$, a $M_w$ of $72\times10^3$, an acid number of 8, a Tg of about 65° C., and a melt viscosity of about $5\times10^6$ poise at 115° C. Migration imaging films were made by hand coating the prepared solution onto a 76 micrometer (3 mil) thick aluminized polyester (Melinex, type 442 available from ICI) using a #4 Mayer rod. The coated film was dried at 115° C. for about 5 minutes by contact with a heated aluminum block. The dried thickness of this adhesive layer was estimated to be about 0.3 micrometer. A copolymer of styrene and co-n-hexylmethacrylate was prepared having the following properties: 80 mole percent styrene and 20 mole percent n-hexylmethacrylate, a $M_n$ of $12\times10^3$, a $M_w$ of $28\times10^3$, an acid number of 0, a Tg of about 51° C., and a melt viscosity of about $3\times10^4$ poise at 115° C. This copolymer of styrene and co-n-hexylmethacrylate was dissolved in cyclohexane to obtain a 13.5 percent (by total weight) solution. Cyclohexane instead of toluene was used to avoid dissolving the adhesive layer. The copolymer of styrene and co-n-hexylmethacrylate solution was coated on top of the adhesive layer with a #10 Mayer rod and the coated film was again dried at 115° C. for 5 minutes to form a softenable layer of the imaging member. The thickness of the dried softenable layer was estimated to be about 2 micrometers. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the styrene and co-n-hexylmethacrylate copolymer was formed. The resulting imaging members had a very uniform optical density of about 1.85.

EXAMPLE II

Additional migration imaging members were prepared with materials and conditions identical to that described in Example I except that no adhesive layer was applied. The resulting imaging members had a very uniform optical density of about 1.85 These additional imaging members were used as a control for comparative purposes.

EXAMPLE III

The prepared migration imaging members, one set containing the adhesive layer as described in Example I and the other set being the control set described in Example II, were imaged by negative corona charging to about −200 volts, imagewise exposing with 400 nanometer light of about 3 ergs/cm$^2$, and heat development at 115° C. for 5 seconds by contact with a heated aluminum block. It was found that the imaging properties, such as resolution and optical contrast density of the image of the migration imaging members of both sets were essentially the same. In other words, the imaging properties of the migration imaging member containing the adhesive layer of this invention remained essentially unchanged compared with existing high quality migration imaging members that did not contain an adhesive layer.

EXAMPLE IV

The prepared migration imaging members, one set containing the adhesive layer as described in Example I and the other set being the control set described in Example II, were tested for resistance to delamination in a wind up test. To perform the wind up test, strips of about 1.27 centimeter×25.4 centimeters (about 0.5 inch×10 inches) from the migration imaging member sets containing the adhesive layer and from the control sets were prepared and thereafter tightly wound around (softenable layer side facing inside) around dowels of 0.32 centimeter (1/8 inch) diameter with an applied tension of 714 g/cm (4 lb/in). Under these identical test conditions, no delamination was observed for the migration imaging members containing the adhesive layer upon unwinding the wound migration imaging members of Example I after at least 5 weeks whereas gross delamination occurred in the control set of migration imaging members during unwinding after merely 48 hours. In another test, migration imaging members from Examples I and II were subjected to a very severe adhesive tape test in which one half the length of a 6 inch long strip of Scotch brand adhesive tape, (#600, available from 3M Co.) was applied to the softenable layer and the other end was pulled vertically away from the softenable layer surface. The migration imaging members containing an adhesive layer were able to withstand the adhesive tape test whereas the softenable layers of the control set of migration imaging members were removed by the adhesive tape. Although these test conditions were many times more severe than those likely to be encountered in any practical usage conditions, e.g. the wind up test was conducted under tension many times higher than that likely encountered during manufacturing and practical usage conditions, there was no damage to the migration imaging member containing the adhesive layer.

EXAMPLE V

Additional migration imaging members were prepared with materials and conditions identical to that described in Example I except that a polyester adhesive (49001, available from E.I. DuPont de Nemours & Co.) doped with an isocyanate curing agent (RC-803, also available from E. I. DuPont de Nemours & Co.) was substituted for the styrene ethylacrylate acrylic acid terpolymer as the adhesive layer. The polyester adhesive and the isocyanate curing agent were dissolved in methyl ethyl ketone solvent and hand-coated onto the aluminized polyester substrate. The polyester adhesive and isocyanate curing agent formed a dried layer having a thickness of about 0.3 micrometer. The final imaging member had a very uniform optical density with no signs of microcrystals or aggregates. This imaging member was used as a control for comparative purposes with an imaging member prepared as described in Example I. The prepared migration imaging members, one set containing the styrene ethylacrylate acrylic acid adhesive layer as described in Example I and the other set being the control containing the polyester adhesive layer, were imaged by negative corona charging to about −200 volts, imagewise exposing with 400 nanometer light of about 3 ergs/cm$^2$, and heat development at 115° C. for 5 seconds by contact with a heated aluminum block. It was found that the optical contrast density of the image in the migration imaging member of the control was severely degraded due to an increase in $D_{min}$ ($D_{min}$ was about 1.3) compared to that of the member containing the styrene ethylacrylate acrylic acid adhesive layer ($D_{min}$ was about 0.72) described in Example I. Additionally because of the rather low Tg (about 28° C.) of the dried polyester adhesive layer, this material was found somewhat tacky and caused some blocking of the film during fabrication on a Dilts coater when the film was tightly wound onto a roll.

EXAMPLE VI

A xeroprinting master precursor member was prepared by dissolving about 10 percent by weight of a copolymer of styrene and co-n-hexylmethacrylate having the following properties: 80 mole percent styrene and 20 mole percent n-hexylmethacrylate, a $M_n$ of $12\times10^3$, a $M_w$ of $28\times10^3$, an acid number of 0, a Tg of about 51° C., and a melt viscosity of about $3\times10^4$ poise at 115° C., and about 2.4 percent by weight of N,N'-diphenyl-N,N'-bis(3''-methylphenyl)-(1,1'-biphenyl)-4,4'-diamine in about 87.6 percent by weight toluene based on the total weight of the solution. The resulting solution was applied by means of a No. 10 wire wound rod to a 12 inch wide 76 micrometer (3 mil) Mylar polyester film (available from E. I. DuPont de Nemours Co.) having a thin, semitransparent aluminum coating. The deposited softenable layer was allowed to dry at about 115° C. for about 5 minutes to form a dried layer having a thickness of about 3.5 micrometers. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micrometer embedded about 0.05–0.1 micrometer below the exposed surface of the copolymer was formed. The resulting imaging member had a very uniform optical density.

EXAMPLE VII

A xeroprinting master precursor member was prepared in which the softenable layer contained a styrene ethylacrylate acrylic acid terpolymer resin having the following properties: 74 mole percent styrene, 25 mole percent ethyl acrylate, 1 mole percent acrylic acid, a $M_n$ of $30\times10^3$, a $M_w$ of $72\times10^3$, an acid number of 8, a Tg of about 65° C., and a melt viscosity of about $5\times10^6$ poise at 115° C. The styrene ethyacrylate acrylic acid terpolymer resin was available from Monsanto Co. as RP1215, in a 50 percent by weight toluene solution. A solution was prepared, consisting of about 10 percent by weight of this terpolymer of styrene ethylacrylate acrylic acid and about 2.4 percent by weight of N,N'-diphenyl-N,N'-bis(3''-methylphenyl)-(1,1'-biphenyl)-4,4'-diamine in about 87.6 percent by weight toluene based on the total weight of the solution. The resulting solution was applied by means of a No. 10 wire wound rod to a 12 inch wide 76 micrometer (3 mil) Mylar polyester film (available from E. I. DuPont de Nemours & Co.) having a thin, semitransparent aluminum coating. The deposited softenable layer was allowed to dry at about 115° C. for about 5 minutes to form a dried layer having a thickness of about 3.5 micrometers. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddishmonolayer of selenium particles having an average diameter of about 0.3 micrometer embedded about 0.05–0.1 micrometer below the exposed surface of the softenable layer was formed. The resulting imaging control member had a very uniform optical density with no signs of microcrystals or aggregates.

EXAMPLE VIII

The migration imaging members of Examples VI and VII were immersed in isoparaffinic hydrocarbon (Isopar L, which is a commonly used xerographic liquid developer carrier and is available from Exxon Inc.) for 24 hours. UV absorption spectra and FTIR spectra before and after immersion were recorded. More than 99 percent by weight of the N,N'-diphenyl-N,N'-bis(3''-methylphenyl)-(1,1'-biphenyl)-4,4'-diamine was found to have leached out of the styrene and co-n-hexylmethacrylate copolymer softenable layer of the migration imaging member of Example VI sample after merely 24 hours whereas more than 95 percent by weight of the N,N'-diphenyl-N,N'-bis(3''-methylphenyl)-(1,1'-biphenyl)-4,4'-diamine was found to have been retained by the styrene ethyl acrylate acrylic acid terpolymer softenable layer of the migration imaging member of Example VII even after 4 weeks.

EXAMPLE IX

The migration imaging members described in Example VIII, after the Isopar L immersion treatment, were taped to an electrically grounded flat metal plate and charged by positive corona charging to a potential of +300 volts and exposed to activating illumination having an intensity of 15 ergs/cm$^2$. The charging and exposing steps were repeated for 1000 cycles. The migration imaging member having the styrene ethylacrylate acrylic acid terpolymer in the softenable layer was observed to have a charge acceptance of about +300 volts and a background potential of about +30 volts upon light exposure and its electrical cycling characteristics were very stable. The migration imaging member having the styrene hexylmethacrylate copolymer in the softenable layer was observed to show hardly any photodischarge due to total loss of charge transport molecule from the softenable layer to the Isopar L, as well as severe cycle up due to charge trapping in the softenable layer.

EXAMPLE X

The prepared migration imaging members described in Example VII were imaged by positive corona charging for about +410 volts, imagewise exposed by contacting a positive silver image, and developed by a combination of vapor and heat processing techniques comprising the steps of pretreating the member by uniform exposure to the vapor of methyl ethyl ketone solvent in a vapor chamber of about 40 seconds and thereafter heating to about 115° C. for about 5 seconds on a hot plate in contact with the polyester substrate. An optically sign-reversed image having excellent image quality and an optical contrast density of about 0.9 ($D_{max}$ about 1.22, $D_{min}$ about 0.32) was obtained. The $D_{min}$ area (unexposed to light) was due to agglomeration and coalescence of selenium particles into few but larger particles in the softenable layer. This xeroprinting master was then taped to a bare drum, replacing the original photoreceptor drum of an automatic copier. The xeroprinting master was then uniformly charged with positive corona charging to a potential of about +400 volts and uniformly exposed to flash illumination to form an electrostatic latent image. The electrostatic latent image was toned with a liquid developer to form a deposited toner image. The liquid developer contained about 2 percent by weight of carbon black pigmented polyethylene acrylic acid resin and about 98 percent by weight of Isopar L. The deposited toner image was transferred and fused to a sheet of paper to yield a very good xeroprint (positive). This xeroprinting process was repeated for at least 1000 times with very good results.

EXAMPLE XI

A xeroprinting master precursor member was prepared in which the softenable layer contained a styrene ethylacrylate terpolymer resin having the following properties: 48 mole percent styrene, 50 mole percent ethyl acrylate, 2 mole percent acrylic acid, a $M_n$ of $21\times10^3$, a $M_w$ of $54\times10^3$, an acid number of 15, a Tg of about 36° C., and a melt viscosity of about $3\times10^3$ poise at 115° C. The styrene ethylacrylate acrylic acid terpolymer resin was available from DeSoto Co. as E-335, a 50 percent by weight toluene/xylene solution). A solution was prepared consisting of about 10 percent by weight of this terpolymer of styrene ethylacrylate acrylic acid and about 2.4 percent by weight of N,N'-diphenyl-N,N'-bis(3''-methylphenyl)-(1,1'-biphenyl)-4,4'-diamine in about 87.6 percent by weight toluene/xylene based on the total weight of the solution. The resulting solution was applied by means of a No. 10 wire wound rod to a 12 inch wide 102 micrometer (4 mil) thick polyester film having a thin, semitransparent aluminum coating. The deposited softenable layer was allowed to dry at about 110° C. for about 15 minutes to form a dried layer having a thickness of about 3.5 micrometers. The temperature of the softenable layer was raised to about 115° C. to lower the viscosity of the exposed surface of the softenable layer to about $5\times10^3$, poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micrometer embedded about 0.05–0.1 micrometer below the exposed surface of the copolymer was formed. The resulting imaging control member had a very uniform optical density.

EXAMPLE XII

A xeroprinting master precursor member was prepared in which the softenable layer contained a styrene ethylacrylate acrylic acid terpolymer resin having the following properties: 48 mole percent styrene, 50 mole percent ethyl acrylate, 2 mole percent acrylic acid, a $M_n$ of $26\times10^3$, a $M_w$ of $49\times10^3$, an acid number of 18, and a Tg of about 32° C. The styrene ethylacrylate acrylic acid terpolymer resin was available from DeSoto Co. as E-048, a 50 percent by weight toluene/xylene solution). A solution was prepared consisting of about 10 percent by weight of this terpolymer of styrene ethylacrylate acrylic acid and about 2.4 percent by weight of N,N'-diphenyl-N,N'-bis(3''-methylphenyl)-(1,1'-biphenyl)-4,4'-diamine in about 87.6 percent by weight toluene/xylene based on the total weight of the solution. The resulting solution was applied by means of a No. 10 wire wound rod to a 12 inch wide 102 micrometer (4 mil) thick polyester film having a thin, semitransparent aluminum coating. The deposited softenable layer was allowed to dry at about 110° C. for about 15 minutes to form a dried layer having a thickness of about 3.5 micrometers. The temperature of the softenable layer was raised to about 115° C. to lower the viscosity of the exposed surface of the softenable layer to about $5\times10^3$ poises in preparation for the deposition of marking material. A thin layer of particulate vitreous seleunium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micrometer embedded about 0.05–0.1 micrometer below the exposed surface of the copolymer was formed. The resulting imaging control member had a very uniform optical density.

EXAMPLE XIII

The migration imaging members of Examples VI, XI and XII were immersed in isoparaffinic hydrocarbon (Isopar L which is commonly used in xerographic liquid developer as carrier medium and is available from Exxon Inc.) for 24 hours. UV absorption spectra and FTIR spectra before and after immersion in Isopar L were recorded. More than 99 percent by weight of the N,N'-diphenyl-N,N'-bis(3''-methylphenyl)-(1,1'-biphenyl)-4,4'-diamine was found to have leached out of the styrene and co-n-hexylmethacrylate copolymer softenable layer of the migration imaging member of the Example VI sample after merely 24 hours whereas about 95 percent by weight of the N,N'-diphenyl-N,N'-bis(3''-methylphenyl)-(1,1'-biphenyl)-4,4'-diamine was found to have been retained by the styrene ethyl acrylate terpolymer softenable layer of the migration imaging member of Example XI and about 96 percent by weight retained by the styrene acrylate copolymer softenable layer of the migration imaging members of Example XII.

EXAMPLE XIV

A migration imaging member prepared as described in Example XI was processed to form a xeroprinting master by negative corotron charging to a surface potential of about −340 volts, imagewise exposed by contacting a negative silver image, and heat developed at 115° C. for 5 seconds. An optically sign-retaining image having excellent image quality and an optical contrast density of about 1.16 ($D_{max}$ about 1.76, $D_{min}$ about 0.60) was obtained. The $D_{min}$ area (light exposed) was due to migrated subsurface selenium particles dispersed in the polymer matrix. This xeroprinting master was then uniformly charged with positive corona charging to a potential of about +400 volts and uniformly exposed to 440 nanometer activating illumination of about 15 ergs/cm$^2$. Surface potentials of +42 volts and +242 volts were respectively observed for the $D_{max}$ and $D_{min}$ areas, resulting in an electrostatic contrast potential of about +200 volts. The uniform positive charging and uniform exposure steps for the $D_{max}$ and $D_{min}$ areas of the heatdeveloped xeroprinting master were repeated several hundred times. The xeroprinting master exhibited very good electrical cyclic stability with a low dark decay of about 2–5 volts/second.

EXAMPLE XV

A xeroprinting master was prepared as described in Example XIV. This xeroprinting master was then taped to a bare drum, replacing the original photoreceptor drum of an automatic copier. The xeroprinting master was then uniformly charged with positive corona charging to a potential of about +400 volts and uniformly exposed to flash illumination to form an electrostatic latent image. The electrostatic latent image was toned with a liquid developer to form a deposited toner image. The liquid developer contained about 2 percent by weight of carbon black pigmented polyethylene acrylic acid resin and about 98 percent by weight of Isopar L. The deposited toner image was transferred and fused to a sheet of paper to yield a very good xeroprint (positive). This xeroprinting process was repeated for at least 1000 times with very good results.

EXAMPLE XVI

A migration imaging member prepared as described in Example XI was processed to form a xeroprinting master by positive corotron charging to a surface potential of about +440 volts, imagewise exposed by contacting a positive silver image, and developed by a combination of vapor and heat processing techniques comprising the steps of pretreating the member by uniform exposure to the vapor of methyl ethyl ketone solvent in a vapor chamber for about 40 seconds and thereafter heating to about 115° C. for about 5 seconds on a hot plate in contact with the polyester substrate. An optically sign-reversed image having excellent image quality and an optical contrast density of about 0.86 ($D_{max}$ about 1.12, $D_{min}$ about 0.26) was obtained. The $D_{min}$ area (unexposed to light) was due to substantial agglomeration and coalescence of selenium particles into few but larger particles in the softenable layer. This xeroprinting master was then uniformly charged with positive corona charging to a potential of about +440 volts and uniformly exposed to 440 nanometer activating illumination of about 15 ergs/cm$^2$. Surface potentials of +50 volts and +270 volts were respectively observed for the $D_{max}$ and $D_{min}$ areas, resulting in an electrostatic contrast potential of about +220 volts. The uniform positive charging and exposure steps for the $D_{max}$ and $D_{min}$ areas of the vapor/heat developed xeroprinting master were repeated several hundred times. The xeroprinting master exhibited very good electrical cyclic stability with a very low dark decay of about 2–5 volts/-second.

EXAMPLE XVII

A xeroprinting master was prepared as described in Example XVI. This xeroprinting master was then taped to a bare drum, replacing the original photoreceptor drum of an automatic copier. The xeroprinting master was then uniformly charged with positive corona charging to a potential of about +440 volts and uniformly exposed to flash illumination to form an electrostatic latent image. The electrostatic latent image was toned with a liquid developer to form a deposited toner image. The liquid developer contained about 2 percent by weight of carbon black pigmented polyethylene acrylic acid resin and about 98 percent by weight of Isopar L. The deposited toner image was transferred and fused to a sheet of paper to yield a very good xeroprint (positive). This xeroprinting process was repeated for at least 1000 times with very good results.

EXAMPLE XVIII

A copolymer prepared by free radical polymerization in toluene by adding 65 mole percent styrene and 35 mole percent ethyl acrylate to a reactor vessel containing a portion of the toluene solvent. These monomers are allowed to equilibrate to the reactor's temperature 85° C. while the system is purged by the bubbling of nitrogen in the monomer solution. The monomer solution is stirred during the purging of the system and during the subsequent polymerization. About 2.01 wt. percent benzoyl peroxide initiator is added to a second portion of the toluene solvent and is allowed to dissolve or mix with the solvent before it is added to the reaction vessel. The polymerization is then allowed to proceed for five hours while the temperature in the reactor is controlled by cooling. The resulting styrene ethylacrylate copolymer resin had the following properties: 66 mole percent styrene, 34 mole percent ethyl acrylate, a $M_n$ of $16\times10^3$, a $M_w$ of $28\times10^3$, an acid number of 0, a Tg of about 60° C., and a melt viscosity of about $7\times10^3$ poise at 115° C.

EXAMPLE XIX

A copolymer was prepared by free radical polymerization in toluene using benzoyl peroxide initiator by adding 70 mole percent styrene and 30 mole percent ethyl acrylate to a reactor vessel containing a portion of the toluene solvent. These monomers are allowed to equilibrate to the reactor's temperature 80° C. while the system is purged by the bubbling of nitrogen in the monomer solution. The monomer solution is stirred during the purging of the system and during the subsequent polymerization. About 1.0 wt. percent benzoyl peroxide initiator is added to a second portion of the toluene solvent and is allowed to dissolve or mix with the solvent before it is added to the reaction vessel. The polymerization is then allow to proceed for five hours while the temperature in the reactor is control by cooling. The resulting styrene ethylacrylate copolymer resin had the following: 73 mole percent styrene, 27 mole percent ethyl acrylate, a $M_n$ of $30\times10^3$, a $M_w$ of $52\times10^3$, an acid number of 0, a Tg of about 68° C., and a melt viscosity of about $5\times10^4$ poise at 115° C.

EXAMPLE XX

A copolymer was prepared by free radical polymerization in toluene using benzoyl peroxide initiator by adding 68 mole percent styrene, 30 mole percent ethyl acrylate and 2 mole percent acrylic acid to a reactor vessel containing a portion of the toluene solvent. These monomers are allowed to equilibrate to the reactor's temperature 90° C. while the system is purged by the bubbling of nitrogen in the monomer solution. The monomer solution is stirred during the purging of the system and during the subsequent polymerization. About 1.0 wt. percent benzoyl peroxide initiator is added to a second portion of the toluene solvent and is allowed to dissolve or mix with the solvent before it is added to the reaction vessel. The polymerization is then allowed to proceed for five hours while the temperature in the reactor is controlled by cooling. The resulting styrene ethylacrylate acrylic acid terpolymer resin had the following properties: 76 mole percent styrene, 22 mole percent ethyl acrylate, 2 percent acrylic acid, a $M_n$ of $27\times10^3$, a $M_w$ of $48\times10^3$, an acid number of 15, a Tg of about 68° C., and a melt viscosity of about $3\times10^4$ poise at 115° C.

EXAMPLE XXI

A first set of xeroprinting master precursor members was prepared in which the softenable layer contained the terpolymer resin described in Example XI. About 13 percent by weight of the styrene ethylacrylate acrylic acid terpolymer resin was mixed with about 2.1 percent by weight of N,N'-diphenyl-N,N'-bis(3''-methylphenyl)-(1,1'-biphenyl)-4,4'-diamine in about 84.9 percent by weight toluene all based on the total weight of the resulting solution. The solution was applied by means of a No. 10 wire wound rod to a 30 centimeter (12 inch) wide 102 micrometer (4 mil) thick polyester film having a thin, semitransparent aluminum coating. The deposited softenable layer was well dried on a heat block at about 110° C. for 15 minutes to insure that the toluene solvent had been thoroughly removed. The dried softenable layer had a thickness of about about 3.5 micrometers. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micrometer embedded about 0.05–0.1 micrometer below the exposed surface of the copolymer was formed.

The foregoing procedures were repeated with identical materials and conditions to prepare second, third and fourth sets of xeroprinting master precursor members except that the copolymer of Example XVIII was substituted for the copolymer of Example XI for the second set of xeroprinting precursor members, the copolymer of Example XIX was substituted for the copolymer of Example XVIII for the third set of xeroprinting precursor members and the copolymer of Example XX was substituted for the copolymer of Example XVIII for the fourth set of xeroprinting precursor members. Each of the resulting sets of xeroprinting master precursor members had a very uniform optical density with no signs of microcrystals or aggregates.

EXAMPLE XXII

Pairs of one inch square pieces were cut from each of the four sets of xeroprinting master precursor members described in Example XXI. A square piece from each pair was placed front to back against the other square piece from the same original pair and subjected to 0.6 kg/cm$^2$ (9 psi) weights at 45° C. for 1 hour. The material from Example XI showed some blocking whereas the materials form Examples XVIII, XIX and XX did not show any evidence of blocking. It is believed that blocking occurred only for the material from Example XI because the test temperature of about 45° C. was above the $T_g$ of the terpolymer of Example XI which was about 36° C. but below that of the copolymers of Examples XVIII (about 60° C.), XIX (about 67° C.) and XX (about 68° C.). It should be noted that the testing conditions were many times more severe than those likely encountered in practical conditions. This example is intended to show that blocking resistance can be improved by a styrene ethylacrylate copolymer having higher Tg.

EXAMPLE XXIII

Samples from the third set of xeroprinting members described in Example XXI containing the terpolymer of Example XX prepared as described in Example XI was processed to form a xeroprinting master by positive corotron charging to a surface potential of about +400 volts, imagewise exposed by contacting a positive silver image, and developed by a combination of vapor and heat processing techniques comprising the steps of pretreating the member by uniform exposure to the vapor of methyl ethyl ketone in a vapor chamber for about 40 seconds and thereafter heating to about 115° C. for about 5 seconds on a hot plate in contact with the polyester substrate. An optically sign-reversed image having excellent image quality and a contrast density of about 0.79 ($D_{max}$ about 1.1, $D_{min}$ about 0.32) was obtained. The $D_{min}$ area (unexposed to light) was due to agglomeration and coalescence of the Se particles into fewer but larger particles in the polymer matrix. This xeroprinting master was then uniformly charged with positive corona charging to a potential of about +460 volts and uniformly exposed to 440 nanometer activating illumination of about 15 ergs/cm$^2$. Surface potentials of +53 volts and +270 volts were respectively observed for the $D_{max}$ and $D_{min}$ areas, resulting in an electrostatic contrast potential of about +217 volts. Both the $D_{max}$ and $D_{min}$ areas of the heat developed xeroprinting master were electrically cycled several hundred times. The xeroprinting master exhibited very good electrical cyclic stability with a very low dark decay of about 2–5 volts/second.

EXAMPLE XXIV

Samples from the third set of xeroprinting members described in Example XXI containing the copolymer of Example XX prepared as described in Example XI was processed to form a xeroprinting master by negative corotron charging to a surface potential of about -400 volts, imagewise exposed by contacting a negative silver image, and heat developed at 115° C. for 5 seconds. An optically sign-retaining image having excellent image quality and a contrast density of about 1.1 ($D_{max}$ about 1.8, $D_{min}$ about 0.7) was obtained. The $D_{min}$ area (light exposed) was due to migrated subsurface selenium particles dispersed in the polymer matrix. This xeroprinting master was then uniformly charged with positive corona charging to a potential of about +400 volts and uniformly exposed to 440 nanometer activating illumination of about 15 ergs/cm$^2$. Surface potentials of +40 volts and +240 volts were respectively observed for the $D_{max}$ and $D_{min}$ areas, resulting in an electrostatic contrast potential of about +200 volts. The uniform positive charging and exposure steps for the $D_{max}$ and $D_{min}$ areas of the heat developed xeroprinting master were electrically cycled several hundred times. The xeroprinting master exhibited very good electrical cyclic stability with a very low dark decay of about 2–5 volts/second. A fresh piece of xeroprinting master prepared as described above was again uniformly charged with positive corona charging to a potential of about +440 volts and uniformly exposed to flash illumination to form an electrostatic latent image. The electrostatic latent image was toned with a liquid developer to form a deposited toner image. The liquid developer contained about 2 percent by weight of carbon black pigmented polyethylene acrylic acid resin and about 98 percent by weight of Isopar L. The deposited toner image was transferred to a sheet of paper by Scotch tape to yield a very good xeroprint (positive). This xeroprinting process was repeated manually for at least 10 times with very good results.

EXAMPLE XXV

A xeroprinting precursor member prepared as described in Example VII was processed to form a xeroprinting master by negative corotron charging to a surface potential of about -440 volts, imagewise exposed by contacting a negative silver image, and heat developed at 115° C. for 5 seconds. A very faint optically sign-retaining image having a contrast density of about 0.1 ($D_{max}$ about 1.85, $D_{min}$ about 1.75) was obtained. It is believed that since the $48\times10^3$ $M_w$ of the terpolymer employed in Example XXIV is much lower than the $72\times10^3$ of the terpolymer utilized in this example (Example XXV), a lower melt viscosity is achieved with the terpolymer employed in Example XXIII at the development temperature utilized which thereby allows particle migration during development.

EXAMPLE XXVI

Samples from the first set of xeroprinting precursor members described in Example XXI containing the terpolymer of Example XI, samples from the third set of xeroprinting precursor members described in Example XXI containing the copolymer of Example XIX, and samples from the fourth set of xeroprinting precursor members described in Example XXI containing the copolymer of Example XX were subjected to a very severe adhesive tape test in which one half the length of a 6 inch long strip of Scotch brand adhesive tape (#600, available from 3M Co.) was applied to the softenable layer and the other end was rapidly pulled vertically away from the softenable layer surface. The xeroprinting precursor members of the first and fourth sets were able to withstand the adhesive tape test with no visible damage whereas the softenable layers of the third set of xeroprinting precursor members suffered severe film removal. It is believed that the acrylic acid component of the terpolymers of Examples XI and XX contribute to the excellent adhesion of the softenable layer to the underlying metallized polyester layer. Thus, the absence of the acrylic acid component from the copolymer of Example XIX in the third set of xeroprinting precursor members described in Example XXI caused the third set of xeroprinting precursor members to fail the adhesive tape test.

EXAMPLE XXVII

An imaging member was prepared as described in EXAMPLE XI but without the charge transport molecules of N,N'-diphenyl-N,N'-bis(3''-methylphenyl)-(1,1'-biphenyl)-4,4'-diamine. The imaging member was imaged by negative corotron charging to a surface potential of about -400 volts, imagewise exposed by contacting a negative silver image, and heat developed at 115° C. for 5 seconds. An optically sign-retaining image having excellent image quality and an optical contrast density of about 1.16 ($D_{max}$ about 1.76, $D_{min}$ about 0.60) was obtained. The $D_{min}$ area (light exposed) was due to migrated subsurface selenium particles dispersed in the polymer matrix.

Other modifications of the present invention will occur to those skilled in the art based upon a reading of the present disclosure. These are intended to be included within the scope of this invention.

What is claimed is:

1. A migration imaging member comprising a substrate and an electrically insulating softenable layer adjacent said substrate, said softenable layer comprising a fracturable layer of electrically photosensitive migration marking material located substantially at or near the surface of said softenable layer spaced from said substrate, and a copolymer of styrene and ethyl acrylate in at least one layer adjacent said substrate, said copolymer comprising between about 40 and about 80 mole percent styrene, between about 20 and about 60 mole percent ethyl acrylate, and between about 0 and about 3 mole percent copolymerizable organic acid having carbon-to-carbon unsaturation or copolymerizable derivative thereof, said copolymer having a $M_n$ between about 4,000 and about 35,000, a $M_w$ between about 10,000 and about 80,000, an acid number up to about 25, $T_g$ between about 30° C. and about 75° C., and a melt viscosity between about $1\times10^2$ poise and about $1\times10^6$ poise at 115° C.

2. A migration imaging member according to claim 1 wherein said copolymer of styrene and ethyl acrylate is contained in a thin, uniform, continuous adhesive layer situated between said substrate and said softenable layer and wherein said layer comprises at least 80 percent by weight, based on the weight of said adhesive layer, of said copolymer.

3. A migration imaging member according to claim 2 wherein said copolymer comprises between about 40 and about 80 mole percent styrene, between about 20 and about 60 mole percent ethyl acrylate between about 1 and about 3 mole percent copolymerizable organic acid having carbon-to-carbon unsaturation or copolymerizable derivative thereof, said copolymer having a $M_n$ between about 10,000 and about 35,000, a $M_w$ between about 25,000 and about 80,000, an acid number between about 8 and about 25, a $T_g$ between about 30° C. and about 75° C., and a melt viscosity between about $1\times10^3$ poise and about $1\times10^6$ poise at 115° C. and said adhesive layer has a thickness of less than about 1 micrometer.

4. A migration imaging member according to claim 1 wherein a uniform, continuous charge transport spacing layer is interposed between said substrate and said softenable layer, said charge transport spacing layer comprising charge transport molecules dissolved or molecularly dispersed in said copolymer of styrene and ethyl acrylate, said charge transport molecules being capable of increasing the charge injection from said electrically photosensitive migration marking material to said softenable layer and being capable of transporting charge to said substrate.

5. A migration imaging member according to claim 4 wherein said copolymer comprises between about 40 and about 80 mole percent styrene, between about 20 and about 60 mole percent ethyl acrylate between about 1 and about 3 mole percent copolymerizable organic acid having carbon-to-carbon unsaturation or copolymerizable derivative thereof, said copolymer having a $M_n$ between about 10,000 and about 35,000, a $M_w$ between about 25,000 and about 80,000, an acid number between about 0 and about 25, a $T_g$ between about 30° C. and about 75° C., and a melt viscosity between about $1\times10^3$ poise and about $1\times10^6$ poise at 115° C.

6. A migration imaging member according to claim 1 wherein said softenable layer comprises said copolymer of styrene and ethyl acrylate.

7. A migration imaging member according to claim 6 wherein said copolymer comprises between about 40 and about 80 mole percent styrene, between about 20 and about 60 mole percent ethyl acrylate between about 0 and about 3 mole percent copolymerizable organic acid having carbon-to-carbon unsaturation or derivative thereof, said copolymer having a $M_n$ between about 10,000 and about 35,000, a $M_w$ between about 25,000 and about 80,000, an acid number between about 0 and about 25, a $T_g$ between about 30° C. and about 75° C., and a melt viscosity between about $1\times10^3$ poise and about $1\times10^6$ poise at 115° C.

8. A migration imaging member according to claim 6 wherein said copolymer comprises between about 40 and about 80 mole percent styrene, between about 20 and about 60 mole percent ethyl acrylate between about 0 and about 3 mole percent copolymerizable organic acid having carbon-to-carbon unsaturation or copolymerizable derivative thereof, said copolymer having a $M_n$ between about 4,000 and about 35,000, a $M_w$ between about 10,000 and about 55,000, an acid number between about 0 and about 25, a $T_g$ between about 30° C. and about 75° C., and a melt viscosity between about $1\times10^2$ poise and about $1\times10^6$ poise at 115° C.

9. A migration imaging member according to claim 1 wherein said softenable layer comprises charge transport molecules, said charge transport molecules being capable of increasing charge injection from said electrically photosensitive migration marking material to said electrically insulating layer, being capable of transporting charge to the substrate and being dissolved or molecularly dispersed in said softenable layer.

10. A migration imaging member according to claim 9 wherein said softenable layer comprises about 2 percent to about 50 percent by weight of said charge transport molecule based on the total weight of said softenable layer.

11. A migration imaging member according to claim 10 wherein said charge transport molecules comprise a substituted, unsymmetrical tertiary amine charge transport molecule.

12. A migration imaging member according to claim 1 wherein said fracturable layer is a monolayer and said substrate has an electrically conductive surface.

13. A migration imaging member according to claim 1 wherein said softenable layer is coated with a protective overcoating comprising a film forming resin.

14. An imaging method comprising providing a migration imaging member comprising a substrate and an electrically insulating softenable layer adjacent said substrate, said softenable layer comprising a fracturable layer of electrically photosensitive migration marking material located substantially at or near the surface of said softenable layer spaced from said substrate, and a copolymer of styrene and ethyl acrylate in at one layer adjacent said substrate, said copolymer comprising between about 40 and about 80 mole percent styrene, between about 20 and about 60 mole percent ethyl acrylate, and between about 0 and about 3 mole percent copolymerizable organic acid having carbon-to-carbon unsaturation or copolymerizable derivative thereof, said copolymer having a $M_n$ between about 4,000 and about 35,000, a $M_w$ between about 10,000 and about 80,000, an acid number up to about 25, a $T_g$ between about 30° C. and about 75° C., a melt viscosity between about $1\times10^2$ poise and about $1\times10^6$ poise at 115° C.; electrostatically charging said member to deposit a uniform charge on said member; exposing said member to activating radiation in an imagewise pattern prior to substantial decay of said uniform charge; and developing said member by decreasing the resistance to migration of marking material in depth in said softenable layer at least sufficient to allow migration of marking material whereby marking material migrates toward said substrate in image configuration.

15. An imaging method according to claim 14 including decreasing said resistance to migration of marking material in depth in said softenable layer by heat softening said softenable layer.

16. An imaging method according to claim 14 including decreasing said resistance to migration of marking material in depth in said softenable layer by solvent vapor softening said softenable layer.

17. An imaging method comprising providing a substrate and an electrically insulating softenable layer on said substrate, said softenable layer comprising charge transport molecules, said charge transport molecules being capable of increasing charge injection from said electrically photosensitive migration marking material to said softenable layer, being capable of transporting charge to said substrate and being dissolved or molecularly dispersed in said softenable layer a fracturable layer of electrically photosensitive migration marking material located substantially at or near the surface of said softenable layer spaced from said substrate, and a copolymer of styrene and ethyl acrylate at or near the surface of said softenable layer adjacent said substrate, said copolymer comprising between about 40 and about 80 mole percent styrene, between about 20 and about 60 mole percent ethyl acrylate, and between about 0 and about 3 mole percent copolymerizable organic acid having carbon-to-carbon unsaturation or copolymerizable derivative thereof, said copolymer having a $M_n$ between about 10,000 and about 35,000, a $M_w$ between about 25,000 and about 80,000, an acid number up to about 25, a $T_g$ between about 30° C. and about 75° C., a melt viscosity between about $1\times10^2$ poise and about $1\times10^6$ poise at 115° C.; exposing said member to activating radiation in an imagewise pattern whereby said electrically photosensitive migration marking material struck by said activating radiation photogenerates charge carriers; decreasing the resistance to migration of migration marking material in said softenable layer sufficiently to allow the light-struck migration marking material to retain a small net charge which allows at most slight agglomeration, slight coalescence, slight migration in depth of marking material towards said substrate or combination thereof; and further decreasing the resistance to migration of marking material in said softenable layer sufficiently to allow migration marking material which escapes radiation to substantially agglomerate and coalesce.

18. An imaging method according to claim 17 including contacting said migration imaging member with a liquid developer a plurality of times for a cumulative total contact time of at least about 24 hours while, during said contact time, maintaining the concentration of said charge transport molecule in said softenable layer at least at 90 percent by weight of the original concentration.

19. An imaging method comprising providing a substrate and an electrically insulating softenable layers on said substrate, said softenable layer comprising charge transport molecules, said charge transport molecules being capable of increasing charge injection from said electrically photosensitive migration marking material to said softenable layer, being capable of transporting charge to said substrate and being dissolved or molecularly dispersed in said softenable layer a fracturable layer of electrically photosensitive migration marking material located substantially at or near the surface of said softenable layer spaced from said substrate, and a copolymer of styrene and ethyl acrylate at or near the surface of said softenable layer adjacent said substrate, said copolymer comprising between about 40 and about 80 mole percent styrene, between about 20 and about 60 mole percent ethyl acrylate, and between about 0 and about 3 mole percent copolymerizable organic acid having carbon-to-carbon unsaturation or copolymerizable derivative thereof, said copolymer having a $M_n$ between about 4,000 and about 35,000, a $M_w$ between about 10,000 and about 55,000, an acid number up to about 25, a $T_g$ between about 30° C. and about 75° C., a melt viscosity between about $1\times10^2$ and about $1\times10^5$ poise at 115° C.; exposing said member to activating radiation in an imagewise pattern whereby said electrically photosensitive migration marking material struck by said activating radiation photogenerates charge carriers; decreasing the resistance to migration of migration marking material in said softenable layer sufficiently to allow migration in depth of migration marking material towards said substrate in image configuration.

20. An imaging method according to claim 19 including contacting said migration imaging member with a liquid developer a plurality of times for a cumulative total contact time of at least about 24 hours while, during said contact time, maintaining the concentration of said charge transport molecule in said softenable layer at least at 90 percent by weight of the original concentration.

21. A migration imaging member according to claim 17 wherein a uniform, continuous charge transport spacing layer is interposed between said substrate and said softenable layer, said charge transport spacing layer comprising charge transport molecules dissolved or molecularly dispersed in said copolymer of styrene and ethyl acrylate, said charge transport molecules being capable of increasing the charge injection from said electrically photosensitive migration marking material to said softenable layer and being capable of transporting charge to said substrate.

22. A migration imaging member according to claim 19 wherein a uniform, continuous charge transport spacing layer is interposed between said substrate and said softenable layer, said charge transport spacing layer comprising charge transport molecules dissolved or molecularly dispersed in said copolymer of styrene and ethyl acrylate, said charge transport molecules being capable of increasing the charge injection from said electrically photosensitive migration marking material to said softenable layer and being capable of transporting charge to said substrate.

* * * * *